United States Patent [19]

Bleuer

[11] 4,449,839

[45] May 22, 1984

[54] KEYBOARD WITH ELONGATE KEYS

[76] Inventor: Keith T. Bleuer, 1663 Wilshire Dr., NE., Rochester, Minn. 55901

[21] Appl. No.: 421,586

[22] Filed: Sep. 22, 1982

[51] Int. Cl.[3] ..... B41J 5/28; B41J 5/10; B41J 5/12

[52] U.S. Cl. ..... 400/485; 400/489; 400/490; 200/339

[58] Field of Search ..... 400/485, 490, 482, 486, 400/487, 489, 100; 84/433, 437; 200/339

[56] References Cited

U.S. PATENT DOCUMENTS

| | | | |
|---|---|---|---|
| 1,143,160 | 6/1915 | Anderson | 400/482 |
| 1,336,151 | 4/1920 | O'Connor | 400/489 X |
| 1,652,464 | 12/1927 | Tyberg . | |
| 2,408,452 | 10/1946 | Stixrud . | |
| 2,449,126 | 9/1948 | Kirkpatrick . | |
| 2,532,228 | 11/1950 | Hesh | 400/485 |
| 3,399,287 | 8/1968 | Euler | 200/339 X |
| 3,633,724 | 1/1972 | Samuel | 400/485 |
| 4,029,915 | 6/1977 | Ojima | 200/5 A |
| 4,265,557 | 5/1981 | Runge | 400/479 |

FOREIGN PATENT DOCUMENTS

| | | | |
|---|---|---|---|
| 2259052 | 6/1974 | Fed. Rep. of Germany | 200/339 |
| 622694 | 9/1978 | U.S.S.R. | 400/490 |

OTHER PUBLICATIONS

Nethken et al., "Dual-Function Key for Upper and Lower Print Control", *IBM Technical Disclosure Bulletin,* vol. 22, No. 7, Dec. 1979, pp. 2663–2664.

McCornack, "Single Keybutton Four-Way Switch", *IBM Technical Disclosure Bulletin,* vol. 21, No. 8, Jan. 1979, p. 3261.

Conway, "Digital X Typewriter Keyboard", *IBM Technical Disclosure Bulletin,* vol. 18, No. 12, May 1976, pp. 4187–4190.

Kowalski, "Semi-Captive Keyboard", *Xerox Disclosure Journal,* vol. 1, No. 2, Feb. 1976, p. 85.

Rowe College Typing, H. M. Rowe Company, Baltimore and Chicago, Revised 1971, Cover Sheet, First Index Sheet and p. 9.

Litterick, "QWERTYUIOP-Dinosaur in a Computer Age", *New Scientist,* Jan. 8, 1981, pp. 66–68.

Advertisement on p. 22 of *Personal Computing Magazine* of Jun. 1982.

*Primary Examiner*—Clifford D. Crowder

[57] ABSTRACT

A keyboard for a typewriter or the like including a series of elongate keys disposed in a row and normally with respect to the front edge of the typewriter or at an acute angle with respect thereto. Each of the keys is depressable when a finger pressure is applied on the center, home tablet surface of the key for causing the typing action of a certain letter; the key is depressable when the finger is reached to a tablet surface adjacent to the upper edge of the key and the key is then depressed to cause the typing action for another letter; and the key likewise provides a typing action for still another letter when the finger is reached downwardly toward the lower edge of the key to a lower tablet surface and the key is then depressed. Numerals may be typed either using separate numeral keys located in a separate row or may be typed by depressing the upper tablet surface on each of the elongate keys after using a shift key to cause the printing of the numeral instead of the letter for which the upper tablet surface is primarily dedicated.

87 Claims, 12 Drawing Figures

KEYBOARD WITH ELONGATE KEYS

BACKGROUND OF THE INVENTION

The invention relates to keyboards and other key operated instruments, such as computer terminals.

The typewriter or computer keyboard that we use today (at the time of this application) is, in its layout, practically identical to that designed by C. Latham Sholes for his typewriter in 1873. It is often called the QWERTY keyboard after the order of the top row of letters and is also called the universal keyboard, since the keyboard is that used in all typewriters sold to the general public. The QWERTY or universal keyboard is described in many publications, one of these being the magazine "New Scientist" of Jan. 8, 1981 in an article beginning on page 66 thereof. The arrangement of letters and keys on the keyboard seems quite arbitrary; however, the keyboard arrangement is well suited to touch typing.

The Sholes typewriter (as well as all typewriters) made until recently (the early 1960s) were mechanical, and each of the keys of the typewriter mechanically moved a type bar toward the paper for a printing action. Nobody knows exactly why Sholes chose the QWERTY keyboard arrangement; however, parts of it clearly owe something to alphabetical order (D-FGH-JKL). The traditional explanation is that the keyboard was designed to keep those type bars which were likely to be pressed on consecutive strokes separated so that the type bars did not clash. Ever since the Sholes typewriter, because there were more typewriters in existence with the QWERTY layout than with any other, manufacturers usually kept to it. Thus, the QWERTY or universal keyboard is universally used today even though other key arrangements have been proposed, such as the Dvorak alternative keyboard described in the "New Scientist" article above mentioned.

The universal keyboard has four parallel rows of keys that extend left to right with respect to the typist positioned in front of the machine. Early such keyboards did not include a shift key so that all of the typing was done in capital letters; however, with those keyboards now in use a shift key is provided so that capitals are typed by pressing the same keys as for lower case letters but with the shift key being depressed. The uppermost or fourth row (the row farthest from the typist) is the numeric row for typing the numerals when the keys in this row are pressed; and the first row (the row closest to the typist) and the second and third rows are all letter rows for typing the letters of the alphabet when the keys of these rows are pressed.

A typist is expected to make the second row a "home" row, and he keeps his fingers on this row except when reaching toward himself to the first or lowermost row or when reaching away from himself to either the third row or to the numeric or fourth row. Each of the rows of keys consists essentially of ten keys, and the third or top lettered row has keys marked with the letters (starting from the left end of the row) Q, W, E, R, T, Y, U, I, O, P. The second or home row has its keys marked with the letters A, S, D, F, G, H, J, K, L,—. Generally the tenth key is used for typing a semicolon or when the shift key is depressed for typing a colon. The lowermost or first row of keys are marked with the letters Z, X, C, V, B, N, M,—,—,—. Generally the eighth key of this row is used for typing a comma and the ninth key of this row is used for typing a period, either when the shift key is depressed or not. The tenth key of this lowermost row is generally used for typing a slash and for a question mark when the shift key is depressed.

The keys of the keyboard are also arranged in approximate columns of four keys each including respectively the corresponding keys of the four rows, the fifth key of all four rows being in the fifth column, for example. The columns, however, do not extend directly toward or away from the typist or at right angles to center lines through any of the rows of keys and are not straight. A touch typist is trained to use any particular finger of his two hands on just one column of keys (except for the two index fingers which reach also for adjacent central columns of keys). For example, the little finger of the left hand normally stays on the "A" key on the left end of the home row and in the first column but may reach toward the operator in the first column to the "Z" key in the first or lowermost row or may reach away from the operator in this column to the "Q" key in the third row or may reach still farther away from the operator to the "1" key in the uppermost or fourth row and in this column. The index finger of the left hand, for example, normally rests on the "F" key in the home row but is used also on a reach for the "V" key in the first row or for the "R" or "4" keys in the third and fourth rows all in the fourth column. This index finger also services in like manner the next, fifth column of keys which are arranged to type "G", "B", "T", and "5" respectively in the home, first, third, and fourth rows.

As previously mentioned, the columns of keys for which the fingers are respectively obligated do not extend directly toward and away from the operator, and the columns of keys are not on straight lines. Corresponding keys in the lowermost and second rows, such as the "Z" and "A" keys in the first column, have their centers on a line that extends about 28° from a normal to any of the center lines of the key rows, while the corresponding keys of the second and third rows in any one column are more normally disposed with respect to the center lines of the rows, particularly at about 16° with respect to normals to the center lines of the rows. The centers of corresponding keys in the home and numeric rows in any one column are about on lines extending at 22° with respect to these normals.

The spacings of keys of the universal keyboard have been made so that the keyboard accommodates itself to the hands of most people. The spacing of the rows of keys is about 20 millimeters (mm) on centers, and the spacing between adjacent keys in each row on their centers is also about 20 mm. There is a spacing of about 8 mm between the adjacent edges or surfaces of keys in the same column, and there is a spacing of about 6 mm between adjacent edges or surfaces of adjacent keys in the same row. Each key on its face has a width (along the row) of about 13 mm and has a height (at 90° to the center line of the row) also of about 13 mm. This results in the key spacing as just described and tends to assure that even though a single finger extends laterally for more than the 13 mm width and 13 mm height when a key is depressed, nevertheless this finger overlaps some of the spacing between this key and the adjacent keys so that only the intended key is depressed. Likewise a finger utilizes some of this same space when an adjacent key in the next column or row is depressed.

This arrangement of keys necessitates a reaching of about 21 mm from the "A" key to the "Z" key or "Q" key on centers and a reaching of about 42 mm from the "A" key to the "1" key by the little finger of the left hand in typing the letters "A" and "Q" and numeral "1". The reach by the small finger of the left hand from the "Q" key to the "Z" key is about 42 mm. All of these keys are in the first column. The reaches between the keys in the other columns are the same. The index finger of the left hand must reach even farther; the reach from the center of the "R" key to the center of the "B" key is about 52 mm. The reaches from any of the numeral keys for which any particular finger is responsible to some of the lettered keys is even greater. The typewriter is arranged so that each of the keys has substantially the same stroke and depression as each of the others (such as 5 mm) so that for those keys that require finger reaching, first the finger is moved to contact the key and then the key is depressed with the same stroke as is required for any of the home row keys.

Thus, due to the haphazard layout of the keys and the substantial distances between them (which are required with the universal keyboard in order that a finger does not simultaneously depress two of the keys at the same time), a flurry of finger activity is required in order that typing may be accomplished; and there is a corresponding fatigue due to this flurry of activity.

Although the universal keyboard was designed more than 100 years ago by Sholes (for his mechanical typewriter), there apparently has been no serious effort to replace the universal keyboard because millions of buyers know how to typewrite by touch on it and obviously do not want to learn a different system. Thus, from very early in typewriter history, the idea of changing Sholes' nonsensical keyboard has been considered to be hopeless. Apparently typists' opinion was against the change, even when there were very few typists and even before touch dominated the scene. This is all true even though so called electronic typewriters recently put on the market are gradually displacing those of the mechanical type. An electronic typewriter has an electrical switch that is actuated by the depression of each of the keys of the keyboard, and these switches are connected to a matrix for causing the proper printing action corresponding to the particular key depressed. There is thus at this time no compulsion due to the mechanics of a typewriter necessitating the use of the haphazardly arranged universal keyboard.

SUMMARY OF THE INVENTION

It is therefore an object of the present invention to provide an improved keyboard which is sufficiently like the universal keyboard so that typists now accustomed to the universal keyboard can with a minimum of retraining change to the keyboard of the invention but which is so arranged that substantially shorter finger reachings are required for typing, particularly in connection with the alphabetic letters to be typed.

The present invention retains the following features of the universal keyboard;

(1) The letters of the keyboard of the invention are still disposed in the same three rows, the home or second row having the same letters A, S, D, F, G, H, J, K, L,—; the first or lowermost row having the letters Z, X, C, V, B, N, M,—,—,— and the third row having the same letters Q, W, E, R, T, Y, U, I, O, P. A fourth or uppermost row preferably is provided with the numerals 1, 2, 3, 4, 5, 6, 7, 8, 9, and 0.

(2) The same columns of letters and numerals are provided which extend crosswise with respect to the rows with the same fingers being responsible for typing the same letters and numerals as with the universal keyboard. The first column for which the little finger of the left hand is responsible has the same letters "Q", "A" and "Z" and also preferably has the same numeral "1", for example. The fourth column has the letters "R", "F" and "V" and preferably the numeral 4; and the fifth column has the letters "T", "G", and "B" and preferably the numeral 5; and the index finger of the left hand is responsible for the letters and numerals in both of these columns. Likewise, the other columns are the same as with which the universal keyboard is arranged.

The main difference between the keyboard of the invention and the universal keyboard is that the letters in each of the columns are disposed on a single elongate key in the keyboard of the invention. The letters "Q", "A", and "Z", for example, in the first column are disposed on a single elongate key with the letter "A" being marked on the key at its center, the letter "Q" being marked on the key on its top and the letter "Z" being marked on the key at its bottom. Likewise, the three letters of the other columns are marked on similar elongate keys all of which are positioned in a row extending in the direction of the rows of letters. Ordinarily, the typist positions his fingers on the centers of the elongate keys and in register with the letters A, S, D, etc. of the home row, and the keys are so arranged that the center portions of the keys are depressed in order to cause a typing of the home row of letters. In order to cause the typing of any of the letters in the third row, the typist reaches to the uppermost portion of the respective elongate key and depresses the key with the same motion and for the same distance as the key is depressed for typing any of the letters in the home row. For typing any of the letters in the first or lowermost row, the typist moves his finger back into register with the lowermost portion of the respective elongate key and depresses the key with the same motion and for the same distance as the key is depressed for typing any of the letters of the home row. Preferably, separate keys are provided for typing the numerals, and these numbered keys are arranged in the same columns as the lettered key portions of the elongate keys. Since the letters of each of the columns are disposed on the same elongate key, it is necessary for a typist to finger reach for materially shorter distances before depressing the key for typing any of the letters in the uppermost or third row or for typing any of the letters in the lowermost or first row, and most typing is done using letters rather than numerals. Thus, a substantial saving in finger activity is obtained.

The elongate keys for typing the letters may extend normally (at 90°) with respect to the center lines of the letter rows of keys or may extend at an angle of 22°, for example, with respect to normals to the center lines of the letter rows. The angle of 22° constitutes an average direction of the keys in any one column measured with respect to keys in the home row of the universal keyboard, and the keyboard of the invention may thus approximate the universal keyboard in this respect also.

In carrying out the invention, each of the elongate keys may tilt slightly when either end portion of the key is depressed, such as for typing a "Q" or a "Z" using the elongate key for the first column, for example; and this slight tilting of the key causes an actuator pin to move into and engage a "Q" switch or a "Z" switch in lieu of an "A" switch that is actuated when the center portion of the key is depressed.

DESCRIPTION OF THE PREFERRED EMBODIMENTS

Figure 1:
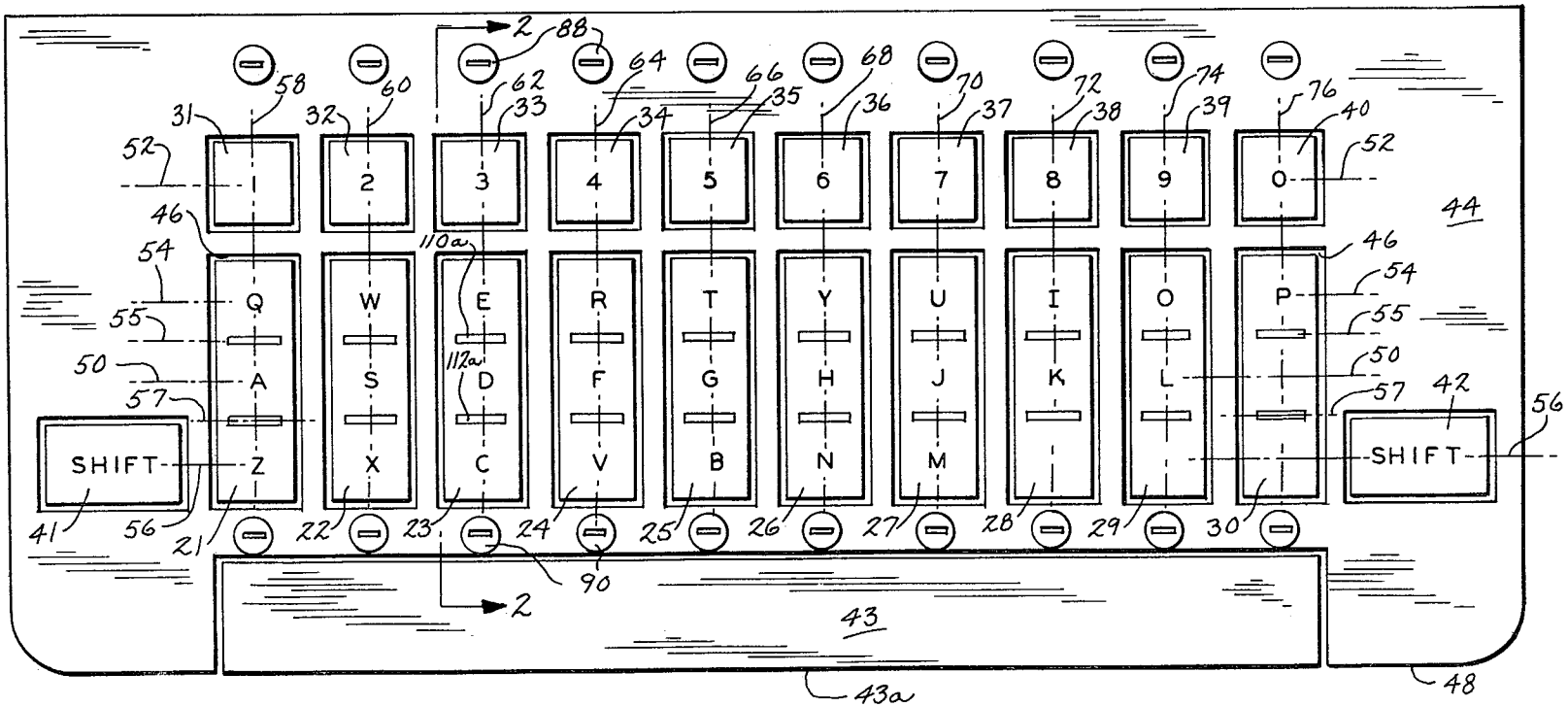
FIG. 1 is top plan view of a keyboard embodying the principles of the invention.

Referring to FIG. 1 in particular, the keyboard illustrated therein may be seen to comprise ten elongate keys 21, 22, 23, 24, 25, 26, 27, 28, 29, and 30 and ten additional keys 31, 32, 33, 34, 35, 36, 37, 38, 39, and 40 which are illustrated as being square. In addition, the keyboard comprises a pair of shift keys 41 and 42 and a space bar 43. The keys project upwardly through a face plate 44, and it will be observed from FIG. 2 that the face plate 44 inclines upwardly from the side on which the space bar 43 is located at about an angle of 10° with respect to horizontal. The keys 21–40 extend upwardly beyond the upper surface of the plate 44 for equal distances, and the upper edges of these keys lie parallel with the plate 44. The keys 21–40 each extends through an opening in the plate 44 of the same shape as the particular key, and a clearance 46 is provided between the edges of these openings and the associated key. The shift keys 41 and 42 are mechanically connected together in accordance with conventional practice so that, when one of these shift keys is depressed, the other one automatically at the same time moves downwardly through its opening in the plate 44. The space bar 43, in accordance with conventional practice, is hingedly mounted within the keyboard so that when its outer edge 43*a* (in alignment with the front edge 48 of the keyboard facing and adjacent the typist) is depressed, the space bar 43 swings downwardly and causes a spacing movement of either the carriage or the typing element in accordance with the conventional practice and using conventional mechanism.

The keys 21–30 have their centers and central portions disposed on a center line 50 which is parallel with the front edge 48 of the keyboard, and the keys 31–40 have their centers on a center line 52 that is parallel to the center line 50 and the keyboard edge 48. Upper portions of the elongate keys 21–30 have their centers disposed on a center line 54, and a center line 55 divides the upper and central portions of these keys. The lower portions of the keys 21–30 have their centers disposed on a center line 56 and a center line 57 divides the central and lower portions of these keys. The center lines 54, 55, 56 and 57 are parallel with center lines 50 and 52 and the front edge 48 of the keyboard. The keys 21–29 have the indicia A, S, D, F, G, H, J, K, and L applied to them respectively on the center line 50, and the key 30 may have any suitable indicia (not shown) as desired applied to it on the center line 50. The upper portions of the keys 21–30 have the indicia Q, W, E, R, T, Y, U, I, O, P applied respectively to them on the center line 54, and the keys 21–27 have the indicia Z, X, C, V, B, N, and M applied respectively to them on their lower portions and on the center line 56. The lower portions of the keys 28, 29 and 30 on the center line 56 may have any suitable indicia (not shown) as desired applied to them. The keys 31–40 have the indicia 1, 2, 3, 4, 5, 6, 7, 8, 9, and 0 applied respectively to them on the center line 52.

It will be observed that the indicia 1, Q, A, and Z and the key pair 21, 31 are in a column that has a center line 58 extending normally or perpendicularly to all of the center lines 50, 52, 54, 55, 56, and 57 and the front edge 48. Likewise, the following mentioned pairs of keys and the indicia thereon are disposed in columns that extend normally to the front edge 48 of the keyboard and the center lines 50, 52, 54, 55, 56, and 57; keys 22 and 32 on center line 60, keys 23 and 33 on center line 62, keys 24 and 34 on center line 64, keys 25 and 35 on center line 66, keys 26 and 36 on center line 68, keys 27 and 37 on center line 70, keys 28 and 38 on center line 72, keys 29 and 39 on center line 74 and keys 30 and 40 on center line 76.

Figure 2:
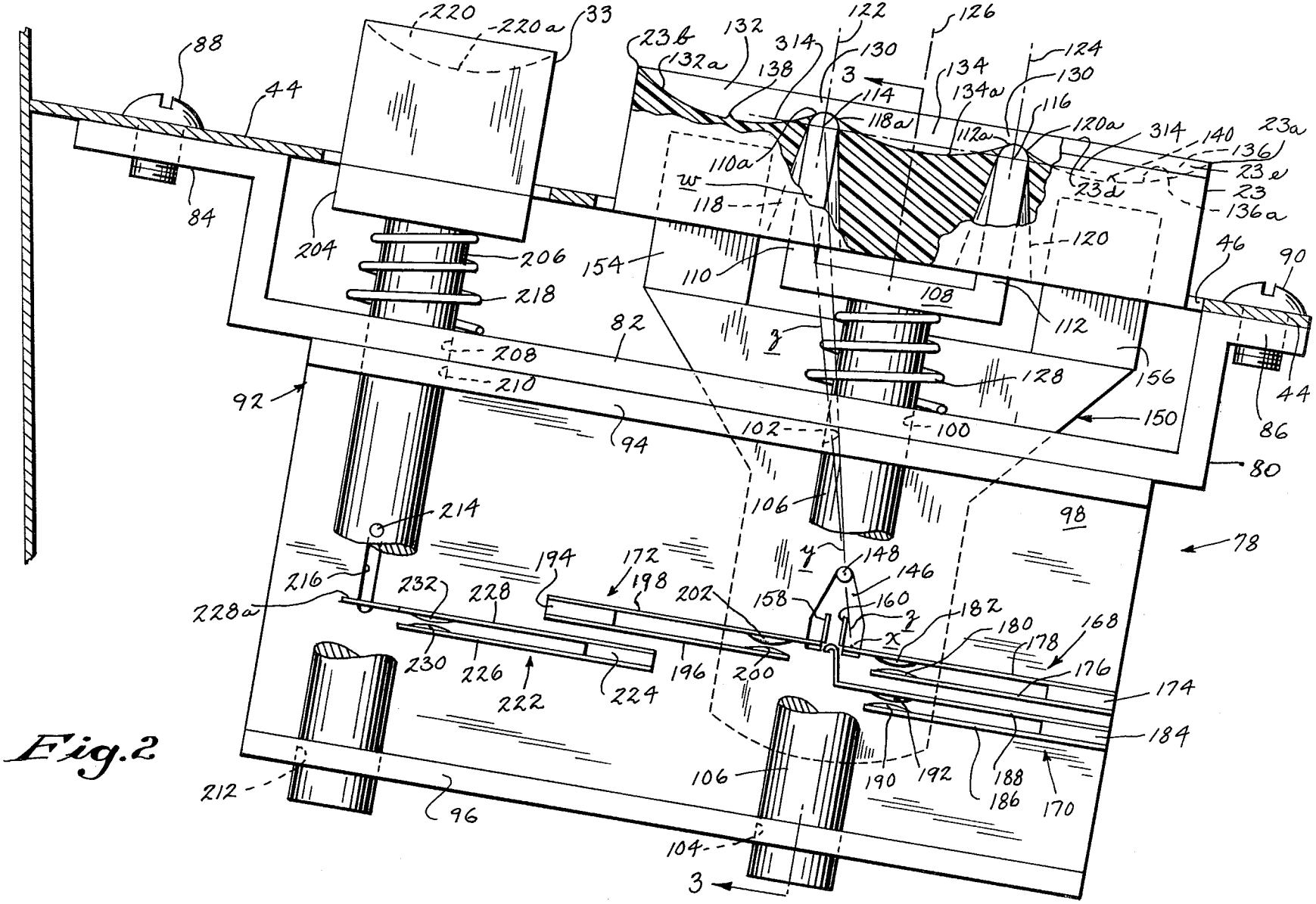
FIG. 2 is a sectional view on an enlarged scale taken on line 2—2 of FIG. 1.
Figure 3:
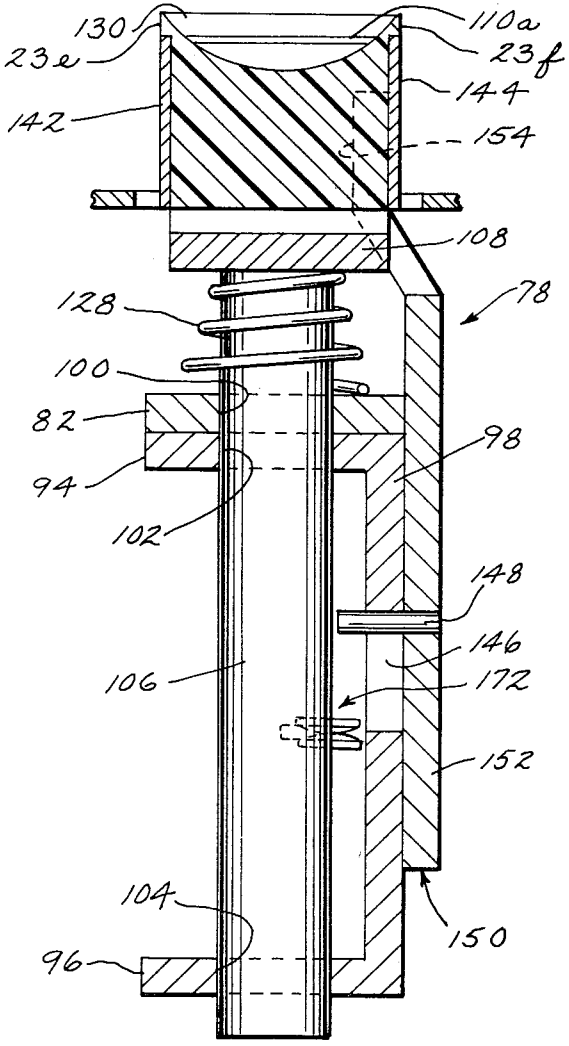
FIG. 3 is a sectional view taken on 3—3 of FIG. 2.

The keys 23 and 33 are supported on and carried by a switch assembly 78 (see FIGS. 2 and 3), and the other pairs of keys just mentioned on the center lines 58, 60, 64, 66, 68, 70, 72, 74, and 76 are carried by and supported by switch assemblies 78 that are identical with that shown in FIGS. 2 and 3. Since the switch assemblies 78 for the various pairs of keys are identical, only the switch assembly 78 for the keys 23 and 33 and shown in FIGS. 2 and 3 will be specifically described.

The switch assembly 78 as shown in FIGS. 2 and 3 comprises a bracket 80 having a central portion 82 extending parallel with the plate 44 and lug portions 84 and 86 that underlie and are in constant contact with the plate 44. Machines screws 88 and 90 extend through openings in the plate 44 and are screwed into the lug portions 84 and 86 for holding the bracket 80 fixed to the underside of the plate 44.

A channel 92 having flange portions 94 and 96 connected by a web portion 98 is fixed to the bracket 80, and in particular the flange portion 94 is fixed to the lower surface of the central portion 82. This fixation may be by any suitable means, such as an epoxy bond, machine screws (not shown) or by any other suitable means. The central portion 82 of the bracket 80 and the flange portions 94 and 96 are respectively provided with openings 100, 102 and 104, and a cylindrical shaft or plunger 106 extends through and is reciprocatable in these openings.

A channel 108 having upwardly extending leg portions 110 and 112 is fixed on the upper end of the shaft 106. The leg portions 110 and 112 have rounded upper ends 110*a* and 112*a* respectively, and these rounded ends are partially cylindrical and have axes 114 and 116 that extend across or transversely of the key 23. The key 23 has recesses 118 and 120 formed therein for receiving the leg portions 110 and 112 respectively; and, as will be observed from FIG. 2, the recesses 118 and 120 broaden out and have their sides diverge toward the bottom surface of the key 23 and have partially cylindrical bearing surfaces 118*a* and 120*a* at their upper ends that engage and mate with respect to the partially cylindrical surfaces 110*a* and 112*a* on the upper ends of the leg portions 110 and 112. It will be observed from FIG. 1 that the curved upper ends of the recesses 118 and 120 are not completely closed and the top surfaces of the curved portions 110*a* and 112*a* of the legs 110 and 112 protrude and are exposed on the upper surface of the key 23. Alternately, the ends of the recesses 118 and 120 may be completely closed, and hide the leg portions 110 and 112 when the upper surface of the key 23 is viewed. The leg portions 110 and 112 respectively have center lines 122 and 124 as seen in FIG. 2, and these extend through the centers 114 and 116 of the curved end portions 110*a* and 112*a* as seen in this figure. The center lines 122 and 124 are more strictly speaking, looking down on key 23, center planes; and the planes 122 and 124 are disposed equal distances from each other and from the two ends of the key 23. The shaft 106 has a center line 126 which may be termed a thrust axis for reasons to be hereinafter made apparent, and the center lines 122 and 124 are equally spaced from the center line 126. The center line 126 is also the center line of the key 23 when the key is in its neutral position in which it is shown in FIG. 2. A compression spring 128 is disposed about the shaft 106 and between the channel 108 and the bracket 80 as shown in this figure.

Figure 5:
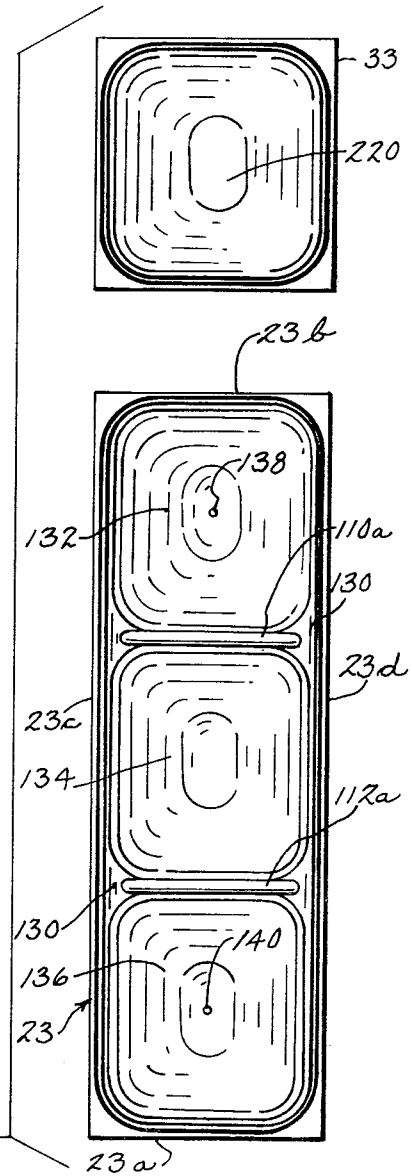
FIG. 5 is a top plan view on an enlarged scale of one of the elongate keys of the keyboard of the invention together with the separate numeric key associated with this elongate key.

The upper surface of the key 23 is provided with a trough 130 (see FIGS. 2, 3 and 5) that extends from the end edge 23*a* of the key 23 to its other end edge 23*b* and which extends between the two side edges 23*c* and 23*d* of the key 23. All of the edges 23*a*–23*d* are at the top of the key 23 and are in a single plane and bound the upper surface of the key 23 which may be considered as a finger thrust surface. It will be observed from FIG. 2 that the curved upper ends 110*a* and 112*a* of the leg portions 110 and 112 lie below the edges 23*c* and 23*d*, and the trough 130 is thus continuous between end edges 23*a* and 23*b*. The upper surface of the key 23 is also provided with recesses or indentations 132, 134 and 136, and the bottom surfaces 132*a*, 134*a* and 136*a* of these indentations also form the bottom surface of the trough 130. The centers of the recesses 132, 134 and 136 and of the trough 130 are all on the longitudinal center line 62 of the key 23 as is evident from FIGS. 1 and 5. The bottom surfaces 132*a*, 134*a* and 136*a* of the indentations 132, 134 and 136 are approximately arcs of spheres as is apparent from an inspection of FIG. 5 and form finger tablet surfaces as will hereinafter appear. The bottom surfaces 132*a*, 134*a* and 136*a* are all on the same lower level below the key edges 23*a*–23 *d*. The bottom surface 132*a* of the indentation 132 extends from the upper edge 23*b* of the key 23 to the center line 122; the bottom surface of the indentation 134 extends from the center line 122 to the center line 124, and the bottom surface of the indentation 136 extends from the center line 124 to the lower edge 23*a* of the key 23. The upper and lower edges of the indentation 134 has the curved ends 110*a* and 112*a* of the leg portions 110 and 112 as its ends, and these curved portions 110*a* and 112*a* are below the side edges 23*c* and 23*d* of the key as shown in FIG. 2. The lower end of the indentation 132 is defined by the curved end 110*a* of the leg portion 110 (positioned at a lower level than the edges 23*c* and 23*d*) while the upper end of the indentation 132 is defined by the key edge 23*b* and thus is higher than the other end of the indentation 132. The indentation 136 has a similar contour and has its upper end defined by the curved portion 112*a* of the leg portion 112 positioned below the side edges 23*c* and 23*d* of the key, while the lower end of the indentation 136 extends up to the key end 23*a*. The key ends 23*a* and 23*b* also define the ends of the trough 130 as has been explained. Relatively sharp upwardly extending projections or bosses 138 and 140 are provided at the centers of the indentations 132 and 136 respectfully for purposes that will be described. A pair of closure plates 142 and 144 are fixed to the two opposite sides of the key 23, and these closure plates are coextensive with the sides of the key except for top portions 23*e* and 23*f* of the key which have their surfaces coplanar with respect to the outer surfaces of the plates 142 and 144.

The web portion 98 is provided with an elongate opening 146 therethrough which may be termed a fixed template opening (see FIG. 4), and a cylindrical pin 148 carried by a link or actuating member 150 extends through the opening 146. The member 150 includes a plate portion 152 in face to face contact with the web portion 98 and includes also two upwardly extending leg portions 154 and 156. The leg portions are molded to the key 23 underneath the plate 144; and, as seen from FIG. 3 in particular, the member 150 extends diagonally from the key 23 to its portion 152 so that the leg portions 154 and 156 and the plate portion 152 are desirably out of line. As is clear from FIG. 3, the pin 148 extends completely through the opening 146 to have its end adjacent the shaft 106.

Figure 4:
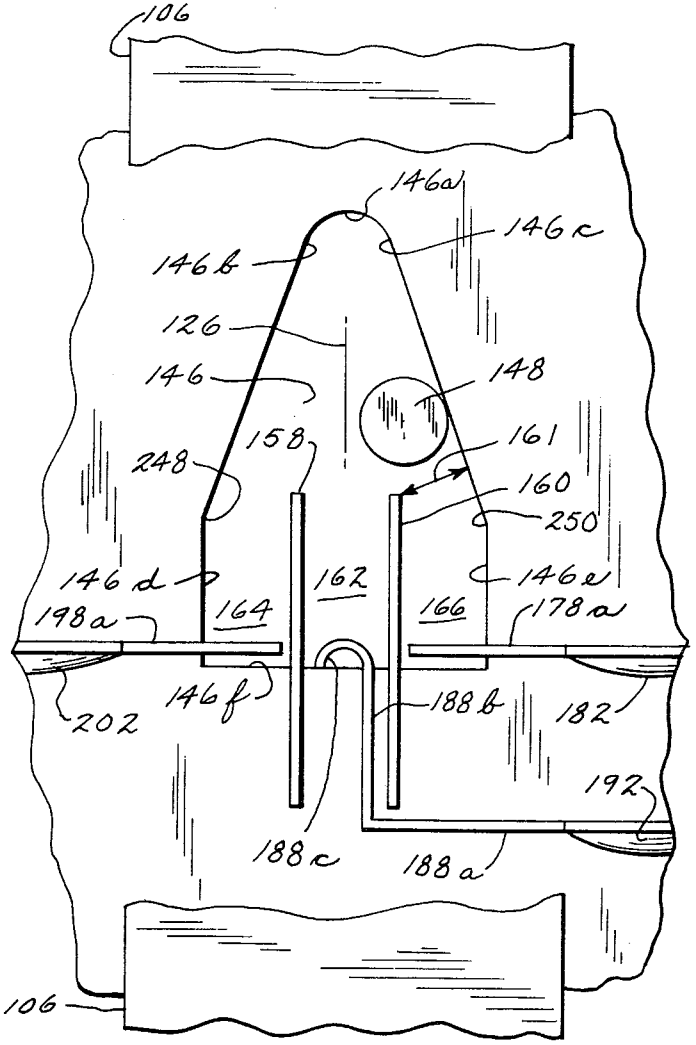
FIG. 4 is a side elevational view on an enlarged scale of the switches and actuator pin constituting a part of the keyboard of the invention and showing the actuator pin in a position which is changed from its position shown in FIGS. 2 and 3.

The opening 146 in the web portion 98 has a curved upper edge 146*a* forming a closed end notch or slot, two upwardly tapering edges 146*b* and 146*c* connected with the curved edge 146*a*, two opposite parallel edges 146*d* and 146*e* connected with the edges 146*b* and 146*c* and a bottom edge 146*f* that is perpendicular to the edges 146*d* and 146*e* and connects these two edges (see FIG. 4). The pin 148 is shown in FIG. 4 in an intermediate position, while the pin 148 is shown in FIGS. 2 and 3 in its uppermost position in engagement with the curved edge 146*a*. The curved edge 146*a* and the pin 148 have the same radius so that the pin 148 fits snugly in contact with the edge 146*a*. A pair of leaf springs 158 and 160 have their lower ends embedded in the web portion 98 and extend upwardly from the edge 146*f* in parallel relationship to the edges 146*d* and 146*e*. The portions of the springs 158 and 160 within the opening 146 are longer than the edges 146*d* and 146*e* so that the upper ends of the springs 158 and 160 are located opposite the edges 146*b* and 146*c*. The distance 161 between the upper end of each of the springs 158 and 160 and the adjacent edge 146*b* or 146*c* is slightly less than the diameter of the pin 148 for purposes to be described. The springs 158 and 160 between them may be said to define a middle slot 162; the spring 158 and the adjacent edge 146*d* may be said to define a side slot 164 and the spring 160 and adjacent edge 146*e* may be said to define another side slot 166.

The pin 148 in moving downwardly through the opening 146 and through the slots 162, 164 and 166 actuates three electric switches 168, 170 and 172 (see FIG. 2). The switch 168 comprises a slab 174 of insulating material and leaf springs 176 and 178. The insulator slab 174 is a fixed on one edge onto the web portion 98, and the leaf springs 176 and 178 are fixed on the slab 174 and out of contact with the web portion 98. The springs 176 and 178 are of electrically conducting material and respectively carry electric contacts 180 and 182. The spring 178 is longer than the spring 176 and has a reduced width portion 178*a* (see FIG. 4) that extends between the shaft 106 and the web portion 98 and into alignment with the slot 166. The switch 170 is of similar construction and includes an insulator slab 184, two leaf springs 186 and 188 and two contacts 190 and 192 carried respectively by the springs 186 and 188. The spring 188 has a portion 188*a* which terminates in an upwardly extending portion 188*b* having a rounded end portion 188*c* (see FIG. 4). The portions 188*a*, 188*b* and 188*c* are of such reduced thickness that they may extend between the shaft 106 and the web portion 98 without interference. The rounded end portion 188*c* is in alignment with the slot 162. The switch 172 is practically identical with the switch 168 and includes a slab 194 of insulating material fixed to the web portion 98, a pair of leaf springs 196 and 198 and a pair of contacts 200 and 202. The leaf spring 198 has a reduced width end portion 198*a* (see FIG. 4) that extends between the shaft 106 and web portion 98 and underlies slot 164 in vertical elevation (see FIG. 4).

The key 33 is fixed on a supporting pad 204 which in turn is fixed on a shaft 206 (see FIG. 2). The shaft 206 extends through axially aligned openings 208, 210 and 212 provided in the bracket portion 82, the flange portion 94 and the flange portion 96. A pin 214 is fixed in the shaft 206 and extends through a slot 216 cut in the web portion 98. A compression spring 218 is provided between the bracket portion 82 and the pad 204. The upper surface of the key 33 is provided with an indentation 220 with tablet surface 220*a* which is in the form of an approximate spherical arc.

The pin 214 actuates a switch 222 which is substantially identical with the switch 168 and comprises a pad 224 of insulating material fixed on the web portion 98, a pair of electrically conductive leaf springs 226 and 228 fixed to the pad 224 and a pair of contacts 230 and 232 carried by the leaf springs 226 and 228. The leaf spring 228 has a reduced width portion 228*a* which is in a position between the shaft 206 and web portion 98 and in line with the pin 214 as it travels through the slot 216 as will be described.

Figures 6, 7, 9, 10, 11:
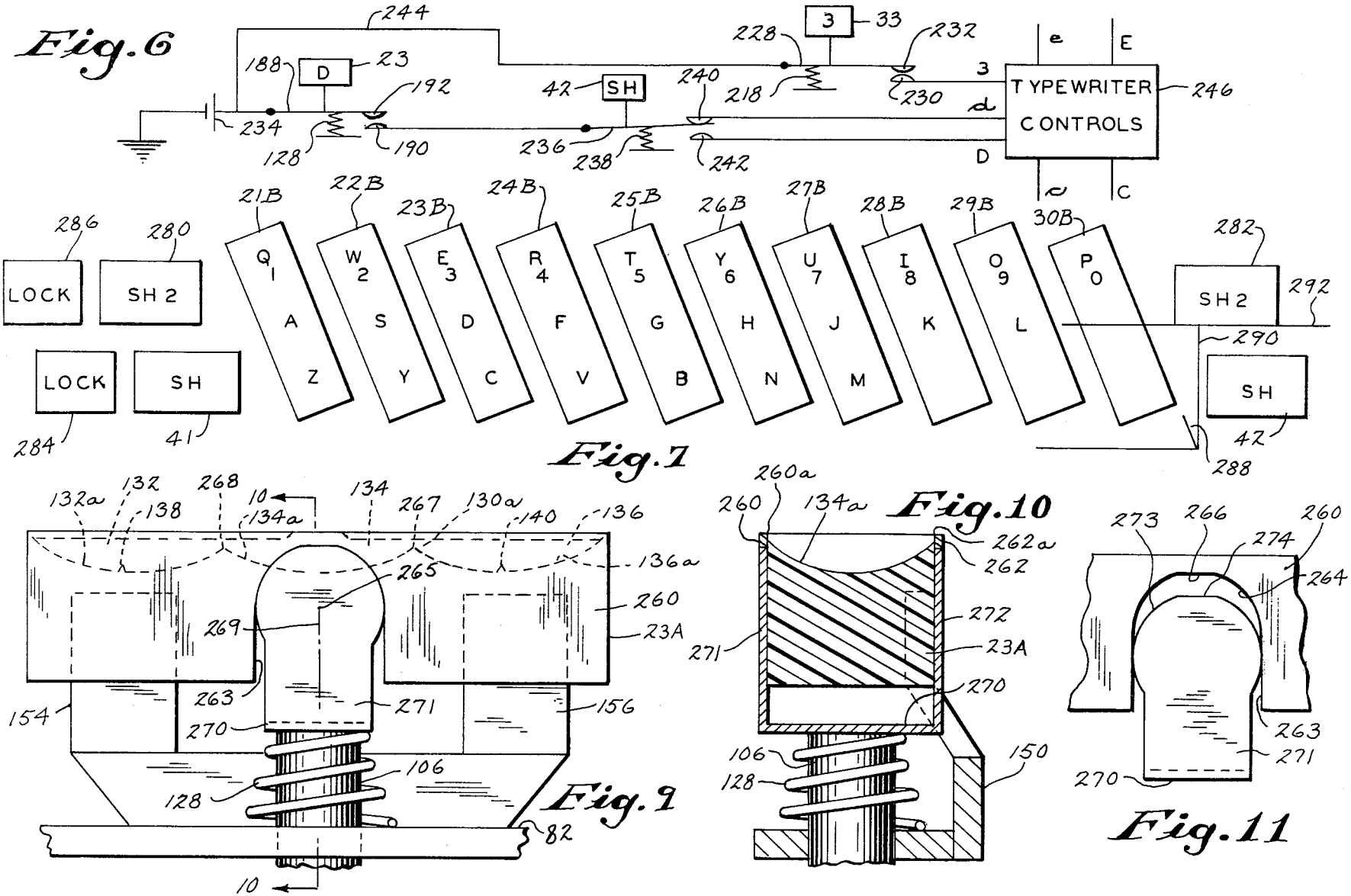
FIG. 6 is a schematic of electrical circuitry that can be used with the keyboard of the invention depicted in the preceding figures.
FIG. 7 is a diagram showing a modified arrangement of the elongate keys of the keyboard of the invention.
FIG. 9 is a side elevational view comparable to the showing of FIG. 2 and showing an elongate key swingably disposed in a modified manner for actuating three electrical switches associated with the elongate key.
FIG. 10 is a sectional view taken on line 10—10 of FIG. 9.
FIG. 11 is a side elevational view fragmentarily showing the supporting structure in exploded relationship for the elongate key illustrated in FIG. 9.

FIG. 6 illustrates electrical circuitry that may be used with the keys 23 and 33. A battery 234 is connected with the leaf spring 188 carrying the contact 192 and actuated by the key 23 when the central portion of the key 23 is depressed as will be hereinafter described. The contact 190 is connected with a switch blade 236 which is actuated by the shift key 42 (or the shift key 41) and which is yieldably held in an uppermost position by means of a spring 238. The switch blade 236 is held by the spring 238 in electrical contact with a contact 240, and when the blade 236 is depressed it makes contact with a contact 242. The battery 234 is connected by means of a lead 244 with the leaf spring 228 under the control of the key 33 and carrying the contact 232. The contact 232 is adapted to make contact with the associated contact 230, and the spring 218 yieldably holds the contacts 230 and 232 out of engagement. The typewriter controls 246 has the input leads D, d, and 3 inputs, and the contacts 242, 240, and 230 are respectively connected with the D, d and 3 inputs to the controls 246. Similar circuitry may be used for connecting the switches 168 and 172 with the e, E, c and C inputs of the controls 246 shown in FIG. 6, and similar circuitry may be used for connecting the corresponding switches actuated by the keys 21,22, 24–30, 31, 32, and 34–40 with the controls 246, as is apparent.

In operation, if any of the keys 31–40 is depessed, the typewriter controls 246 is controlled so that the corresponding numeral as marked on this key is typed. Likewise, if the center portions of any of the keys 21–30 is depressed, the corresponding letter as marked on the key is typed. If the upper portion of any of these keys is depressed, the corresponding letter as marked on the upper portion of this key is typed. If the lower portion of any of these keys is depressed, the letter as marked on the lower portion of this key is typed. If either of the shift keys 41 and 42 is depressed (a depression of one of the shift keys due to its mechanical connection with the other shift key causes the other shift key to move downwardly at the same time) capital letters in lieu of lower case letters are typed using the keys 21–30. Since all of the keys 21–30 and 31–40 work in the same manner, only the operation of the pair of keys 23 and 33 will be given as an example.

All of the eight fingers used in typing are normally over the A,S,D,F,J,K,L,—home positions on the keys 21–30, and the fingers are positioned in the central indentations 134 of each of these keys. If it is desired that the typewriter print the numeral "3", the middle finger of the left hand is reached from its home position over the letter "D" on key 23 to the key 33, and the finger is placed in the indentation 220 on key 33, which holds the finger in place over the key 33, and the key 33 is depressed by the finger acting on the tablet surface 220*a*. The key 33 thus moves downwardly against the action of the spring 218, moving the shaft 206 downwardly and moving the pin 214 downwardly in the slot 216. The pin 214 in its downward movement strikes the portion 228*a* of the leaf spring 228 to bring the contact 232 carried thereby into contact with the contact 230 carried by the leaf spring 226 of the switch 222. Referring to FIG. 6, an electric circuit is thus completed from the voltage source 234 to the typewriter controls 246 through the "3" input lead for the controls, and the controls are effective to cause the typewriter to type a "3". After the typing action is complete, the key 33 is allowed to return to its original position as illustrated in FIG. 2 due to the action of the spring 218, opening the switch 222; and the finger is then returned to its home position over the letter "D" on the key 23.

If it is desired to type the letter "d", it is simply necessary for the third finger of the left hand to depress the key 23, applying pressure at the longitudinal center of the key 23 in the indentation 134 and on the bottom or finger tablet surface 134*a*, necessitating no movement of this finger from its home position which is in the indentation 134. This depression of the key 23 applies pressure through the leg portions 110 and 112 and particularly through the upper curved surfaces 110*a* and 112*a* of the leg portions 110 and 112 by virtue of the curved surfaces 118*a* and 120*a* on the key 23 so as to move the channel 108 and shaft 106 downwardly. The shaft 106 moves through the openings 100, 102 and 104 on the longitudinal central axis of the shaft 106 which may be considered as the thrust axis of the key 23 and shaft 106 and which in the neutral unswung FIG. 2 position of the key is normal to the upper surface of the key bounded by the edges 23*a*–23*d* that may be considered as the finger thrust surface of the key. This thrust axis of the key 23 and of the shaft 106 is represented by the center line 126 shown in FIG. 2 and is also perpendicular to the plane 314 that passes through the centers 114 and 116. The pin 148 is moved straight downwardly in the opening 146 along the center line 126 (see FIG. 4 in particular). The pin 148 is carried by the actuating member 150, and the actuating member 150 is fixed with respect to the key 23 and moves downwardly along with the shaft 106. The movement of the pin 148 is straight downwardly without any substantial tendency to move either to the left or to the right (see FIG. 4), since an unintentional lateral force applied by the finger on the key 23 toward either the end 23*a* or the end 23*b* of the key 23 will not cause any rotation or swinging movement of the key 23 inasmuch as the indentation 134 is located between the upper ends 110*a* and 112*a* of the leg portions 110 and 112 and the bottom surface 134*a* is at a height below the upper ends 110*a* and 112*a* of the legs 110 and 112 on which force is exerted by the bearing surfaces 118*a* and 120*a*. Finger pressure on the tablet surface 134*a* holds both of the bearing surfaces 118*a* and 120*a* against the curved upper ends 110*a* and 112*a* of the leg portions 110 and 112 against the force on the channel 108 due to the spring 128, and the key 23 is thus fixed at this time with respect to the channel 108 and shaft 106. The shaft 106 can only have longitudinal movement, since it extends through the stationary portions 82, 94 and 96; and thus this finger pressure is effective to hold the key 23 from rotation or swinging movement under these conditions. This arrangement thus functions as a detent yieldably holding the key 23 in its neutral unswung position with respect to the shaft 106 in which the key is shown in FIG. 2. The pin 148 thus passes between the leaf springs 158 and 160 and into and downwardly in the slot 162. When the pin 126 reaches the lower end of the slot 162, it strikes the curved end portion 188*c* of the leaf spring 188 of the switch 170, springing the leaf spring 188 and moving its contact 192 into contact with contact 190 carried by the lower leaf spring 186 of the switch 170. Referring to FIG. 6, a circuit is thus completed from the voltage source 234 through the leaf spring 188, the contacts 192 and 190, the switch blade 236, and the contact 240 to the "d" input of the typewriter controls 246. The typewriter controls 246 thus are caused to control the typewriter so as to type the letter "d". In the event it was desired to type the capital letter "D", the shift key 42 or the shift key 41 (which move downwardly together) is depressed so as to move the switch blade 236 into contact with the contact 242, and the "D" input to the controls 246 is energized; and the typewriter instead types the letter "D". After the typing action is completed, the third finger of the left hand releases the force applied on the bottom surface 134*a* of the indentation 134, and the key 23 and pin 148 return to their positions as illustrated in FIG. 2 under the action of the spring 128.

It will be assumed in the further description of the operation of the key 23 that neither of the shift keys 41 and 42 is depressed so that the lower case letters will be typed on further depressions of the key 23, it being understood of course that it is only necessary to depress the shift key 41 or 42 to obtain the typing action of a capital letter. When it is desired to type the letter "e", the third finger of the left hand is moved longitudinally in the trough 130; and the sides of the trough 130 bounded by the edges 23*c* and 23*d* tend to guide the finger longitudinally of the key 23 into a proper position spaced from the home position of the finger in the indentation 134. The finger passes over the exposed end surface 110*a* of the leg portion 110 indicating to the typist that the finger is reaching into the proper indentation 132 for typing the letter "e", and the reaching movement of the finger is continued until the finger is indented by the small upwardly facing boss 138 in the indentation 132. The indentation 132 as has been described and as is shown in FIG. 2 is bounded by the end edge 23*b* at the same levels as the edges 23*c* and 23*d*, and the finger reaching movement is also determined and limited by this sharply and upwardly curved end portion of the indentation 132. The operator then, after this finger reaching, depresses the key 23 against the action of the spring 128, moving both the shaft 106 and the actuating member 150 downwardly against the action of this spring. The shaft 106 moves on its central longitudinal thrust axis; and the key 23 also moves downwardly on this axis but also has a slight swiveling or rotation as will now be described. Since the indentation 132 is on the upper side of the leg end 110*a*, there is a twisting force put on the key 23 inasmuch as the spring 128 restrains downward movement of the key 23 and shaft 106; and the pin 148 moves out of its centralized position in contact with edge 146*a* of the opening 146 and moves downwardly along the slanted edge 146*c* of the opening 146 as the key 123, and particularly its upper end, is depressed. The upper end 110*a* of the leg portion 110 acts as a fulcrum or pivot with respect to the key 23, and the bearing surface 118*a* of the key moves around the curved surface 110*a* of the leg portion 110 and about the axis 114. As the pin 148 moves along the edge 146*c*, the bearing surface 120*a* of the key separates slightly from the round end 112*a* of the leg portion 112. During this downward movement of the pin 148, it eventually reaches the leaf spring 160 and spreads the leaf spring 160 slightly away from the edge 146*c* allowing the pin 148 to move into the slot 166 and downwardly in the slot 166 until the pin reaches the portion 178*a* of the leaf spring 178 forming a part of the switch 168. The leaf spring 178 is thus sprung slightly, and the contact 182 carried by the leaf spring 178 moves into contact with the contact 180 thus completing an electrical circuit to cause controls 246 to type the letter "e". The electrical circuitry for controlling the controls 246 to print the letter "e" are the same as shown in FIG. 6 except that the contacts 240 and 242 are connected with the input lines e and E in lieu of the lines d and D. In addition, in this circuitry, the leaf spring 188 would be replaced by the leaf spring 178; the contact 192 would be replaced by the contact 182 and the contact 190 would be replaced by the contact 180. The circuitry functions in the same manner for typing the letter "e" as for typing the letter "d".

After the contact 182 has made contact with the contact 180 and the typewriter has printed the letter "e", the finger is released from the key 23 and particularly from the indentation 132; and the spring 128 is allowed to move the key 23 and associated parts back into their positions as shown in FIG. 2. During this movement, the pin 148 travels upwardly through the slot 166 and between the upper end of the leaf spring 160 and the slanted edge 146*c* of the opening 146; and the slanted edge 146*c* returns the pin 148 into its original position in which it rests on the curved upper edge 146*a* of the opening 146, wherein the pin 148 is again centered on the center line 126.

The typing action for the letter "c" is similar to that for the letter "e". When the typist wishes to type the letter "c", he moves the third finger of his left hand from its home position in the indentation 134, across the curved upper edge 112*a* of the leg portion 112 into the indentation 136 and into contact with the upwardly extending boss 140 which pricks his finger slightly and notifies him thereby that he is in the proper position for actuating this end of the key 23. In making this movement, his finger is guided by the trough 130. The typist then depresses the key 123 and particularly the bottom surface 136*a* of the indentation 136, and the key 23 and the associated parts move downwardly against the action of the spring 128. In this case, the force on the lower end of the key 23 in the indentation 136 provides a swinging force on the key 23 swinging the key 23 about the curved surface 112*a* acting as a pivot and axis 116 and holding the pin 148 in contact with the slanted edge 146*b* of the opening 146; and, as the parts move downwardly, the pin 148 moves between the leaf spring 158 and the slanted edge 146*b* into the slot 164. The pin 148 then travels to the lower end of the slot 164 and actuates the leaf spring 198 and moves the contact 202 into contact with the contact 200. As the circuitry is shown in FIG. 6, these contacts may replace the contacts 190 and 192, and the contacts 242 and 240 are connected with the control lines c and C of the typewriter controls 246. The supplying of voltage to the control line c for the controls 246 by the closure of contacts 200 and 202 has the effect of causing the controls to cause the typewriter to type the letter "c". When the typing action has been completed, the typist releases the key 23 particularly in the indentation 136 and allows the key 23 and associated parts to return to their original positions as shown in FIG. 2. The pin 148 in traveling up the slanted edge 146*b* returns the key 23 to its neutral position in which the pin 148 is in contact with the upper curved edge 146*a* of the opening 146.

It is thus apparent that in typing the letters "e" and "c", the typist moves the third finger of his left hand through the trough 130 extending longitudinally of the key 23 of its upper surface, and this trough guides his finger and keeps it from moving laterally off of the key 23 and properly positioned on the key 23. Movement of his finger across either the raised upper surface 110*a* or 112*a* from the neutral position of the finger in the indentation 134 signals to the operator that his finger is approaching the proper position longitudinally of the key 23 for a depression of the key 23 in order to produce the desired typed letter, and the projection 138 or the projection 140 gives a tactile sense to the typist that his finger has reached the proper spot on the key 23 for the then depression of the key to complete the typing action. The severely curved ends of the depressions 132 and 136 at the key ends 23*a* and 23*b* also give to the operator the sense of having completed the proper reaching movement in the trough 130 for an immediate depression of the key 23 and also prevent the operator's finger from moving longitudinally of the key 23 too far. The parts 146*d*, 158, 160 and 146*e* defining the slots 164, 162, and 166; and the opposite journal surfaces 110*a*, 118*a*, 112*a* and 120*a* allowing swinging of the key 23 may be said to constitute mechanical switching means allowing the pin 148 to selectively close the three electrical switches 168, 170 and 172.

It should be noted that the leaf springs 158 and 160 provide a tactile effect with respect to the key 23 when either the letter "e" or the letter "c" is being typed. This is particularly due to the fact that the upper ends of the leaf springs 158 and 160 are located at the distance 161 from the adjacent edges 146*b* and 146*c*, less than the diameter of the pin 148. As the pin 148 enters either the slot 164 or the slot 166, the pin 148 flexes the leaf spring 158 or the leaf spring 160 slightly toward the center line 126, providing a momentary resistance or impediment to downward movement of the key 23 felt by the typist. The sharp corners 248 and 250 have substantially the same tactile effect. As the pin 148 passes from the slanted edge 146*b* to the edge 146*d* and across the corner 248, there is a momentary resistance or impediment to movement of the key 23 that is felt by the typist; and the same is true with respect to the edges 146*c* and 146*e* and the corner 250.

The key 23 also swings when either the letter "e" or the letter "c" is being typed, but the sharp corners 248 and 250 and the leaf springs 158 and 160 are relied on mainly to provide the designed tactile effect, inasmuch as the swinging movement of the key 23 is slight. For example, if the swinging movement is due to finger pressure in the indentation 132, the key 23 pivots about the curved upper end 110*a* of the leg portion 110 by means of the bearing surface 118*a* on the key 23. During the depression of the key 23, the pin 148 goes to the bottom of the slot 166; and its center is then at the point x (see FIG. 2). At the same time, the center or axis 114 of the curved upper end 110*a* of the leg portion 110 has descended to the point w. The centers of the pin 148 and curved end 110*a* initially may be connected by the center line y; and, after this movement of the pin 148 to the bottom of the slot 166, a center line z may connect the new centers of the pin 148 and curved end 110*a*. It will be observed from FIG. 2 that the center lines y and z are nearly parallel; and, from measurement, they are at an angle of about 2 degrees. Therefore, since all points of the key 23 are at a fixed angular relationship with respect to center lines through the center 114*a*, inasmuch as pivoting of the key 23 takes place about the curved upper end 110*a* of the leg portion 110, it is thus apparent that very little swinging movement or rotation of the key 23 has occurred during this movement of the pin 148 to make the switch 168. This slight swinging movement is due to the fact that the actuating member 150 is quite long compared to the distance from the center line 122 to either the center of the indentation 132 or the end 23*b* of the key 23 and is also due to the fact that the opening 146 defining the extent of swinging movement of the key 23 is quite narrow. It is apparent therefore, particularly from a consideration of FIG. 2, that the pin 148 moves transversely from the center line 126 into the slot 166 (or slot 164) a substantially shorter distance than the pin 148 (and the key 23) move in the direction of the center line 126 (on the thrust axis of the key 23) for closing either the switch 168 (or 172), the transverse movement of pin 148 for selecting the outer slot 166 for example being thus relatively minor compared to the switch closing movement of the pin 148 in the direction of the center line 126 on the thrust axis of the key 23.

FIGS. 9, 10, and 11 show a modified support for the key 23A in which the key 23A has only a single swinging axis in lieu of two swinging axes. The key 23A is substantially the same as the key 23 except that the transversely extending recesses 118 and 120 are omitted. The actuating member 150 is attached to the key 23A by means of the leg portions 154 and 156 in the same manner that the actuating member 150 is attached to the key 23. The plates 142 and 144 in the first embodiment are replaced by the plates 260 and 262 which are coextensive with the side surfaces of the key 23A except for cutouts 263 in the plates 260 and 262. The cutouts 263 provide simi-circular edges 264 (note FIG. 11) with centers 265 but which are incomplete at the top with flats 266. The key 23A has the same indentations 132, 134 and 136 with the bosses 138 and 140 as described in connection with the first embodiment, but the indentations are separated by the simple transversely extending upraised ridges 267 and 268 which are below the side edges of the key 23A by about the same distances as the rounded portions 110*a* and 112*a* are below the side edges of the key 23 in the first embodiment. The upper edges of the plates 260 and 262 are beveled to provide beveled edges to the trough 130*a* (corresponding to the trough 130 in the first embodiment) except just over the centers 265 where there is no such beveling. This provides the relatively sharp edges 260*a* and 262*a* shown in FIG. 10 on the center line 269 passing through the center 265 shown in FIG. 9. The edges 260*a* and 262*a* of the plates 274 and 276 provide a tactile indication to the operator that his finger is on the tablet surface of indentation 134. The key 23A is swingably mounted with respect to the shaft 106 by means of a channel-shaped part 270 having legs 271 and 272 that extend around and embrace the key 23A. It will be noted that the channel-shaped part 270 is mounted on the shaft 106 at 90° with respect to the channel 108. The leg portions 110 and 112 of the channel 108 extend transversely of the key 23 while the legs 271 and 272 extend longitudinally of the key 23A. The legs 271 and 272 have upper ends that have surfaces 273 (note FIG. 11) that are circular and extend for more than 180 degrees about the center 265 when the parts are assembled as in FIG. 9. FIG. 11 shows the parts 270 and 260 partially disassembled to show them more clearly. The upper ends of the legs 271 and 272 also have flats 274 that are of the same length as the flats 266 and mate with the flats 266 as will be described. The flats 266 and 274 are all at right angles to the center line 269 when the parts are assembled and the key 23A is in its neutral position as shown in FIG. 9 (when the pin 148 is on the center line 126).

The key 23A mounted on the channel-shaped part 270 functions in much the same manner as the key 23. When downward force is put on the curved finger surface 134*a*, the pin 148 moves directly downwardly in the opening 146 and into the slot 162 while when force is put on either of the finger receiving surfaces 132*a* and 136*a*, the key 23A has a swinging force put on it thereby, and the pin 148 moves either into the slot 164 or the slot 166. When the key 23A swings, the circular edges 264 and 273 tend to move as bearings to allow the swinging with the edges 273 constituting pivots. The flats 266 and 274, however, tend to remain in register so that the edges 264 and 273 are not in close contact under these conditions. The flats 266 and 274 are disposed at right angles to and are centered on the center line 269 when the key 23A is in its neutral position with respect to the shaft 106 (see FIG. 9) in which the letter "d" would be typed so as to tend to keep the key 23A in this disposition with respect to the shaft 106 under finger force (on or approximately on the center line 269) to assure that the letter "d" is typed when the finger is used in the central indentation 134 even though some lateral force may unintentionally be used by the finger on the ends of the indentation 134. The location of the upper ends of the circular edges 273 above the bottom surface 134*a* of this indentation 134, which is the finger tablet surface, also has this effect. The flats 266 and 274 thus make up a finger force operated detent tending to keep the key 23A in its neutral disposition illustrated in FIG. 9, and the detent action as well as the centering action due to the placement of the upper parts of the circular edges 264 above the bottom of the indentation 134 are overcome when the finger is used in the indentation 132 or 136 of FIG. 9 to apply a torque on the key 23A to type the letter "e" or "c". The flats 266 and 274 disengage under these conditions and in doing so provide a tactile effect. It will be noted that the tablet surfaces 132*a* and 136*a* in FIG. 9 are spaced to the sides of the center line 269 for substantial distances so the finger pressure on these surfaces does not tend to force the flats 266 into firmer contact with the flats 274 to make the detent action of the flats 264 and 266 effective, while the opposite is true when finger pressure in on the center line 269 (or close to it) for a typing of the letter "d" wherein the detent action of the flats is very effective due to finger pressure.

The embodiment of the invention shown in FIG. 7 includes the same switch assemblies 78 as described in the first embodiment except that the keys 31–40 are omitted, and only the keys 21B–30B are used. Thus, the same switch mechanism used with the key 23 and which is shown in FIG. 2 is used for each of the keys 21B–30B with each of the keys 21B–30B actuating three different switches depending on whether the central portion or one of the two ends of each key is depressed. The keys 21B–30B are the same as the keys 21–30 except that the numerals 1, 2, 3, 4, 5, 6, 7, 8, 9, and 0 have been added as indications respectively to the keys 21B–30B and the indicia "Q", "W", "E", etc. have been slanted on the keys as shown in FIG. 7. The two shift keys 41 and 42 are used as shown, and in addition two additional shift keys 280 and 282 are used. The two additional shift keys 280 and 282 are mechanically connected together in the same manner that the keys 41 and 42 are connected together so that, when one of the keys 280 and 282 is depressed, the other automatically moves downwardly also into shifting position. A lock key 284 and a lock key 286 are respectively provided for the shift keys 41 and 280. The lock key 284, in accordance with conventional operation, when depressed functions also to move the shift keys 41 and 42 downwardly and holds these shift keys depressed until one of the shift keys is itself depressed. Likewise, the lock key 286 when depressed automatically moves the two shift keys 280 and 282 downwardly, and these remain depressed until one of the two keys 280 and 282 is itself depressed.

It will be noted that the keys 21B–30B are each mounted at an angle 288 with respect to the normal 290 to the central axis 292 that extends parallel with the front edge 48 of the machine. The angle 288 may for example be 22° which is the average angle at which keys in a column extend with respect to the home key in the home row of the universal keyboard. As has been previously mentioned, in any one particular column of keys in the universal keyboard, the numeral key is at the angle of 22° with respect to the home key; the key in the first row is at an angle of 28° with respect to the home row key and the angle of the key in the third row with respect to the home row key is 16°. The average of these angles is the angle of 22° just mentioned in connection with the angle 288. For a typist accustomed to the universal keyboard and particularly to the angle at which the keys in any one column are disposed with respect to a normal to the axis of any one row, the keyboard arrangement of FIG. 7 may be desirable.

Figure 8:
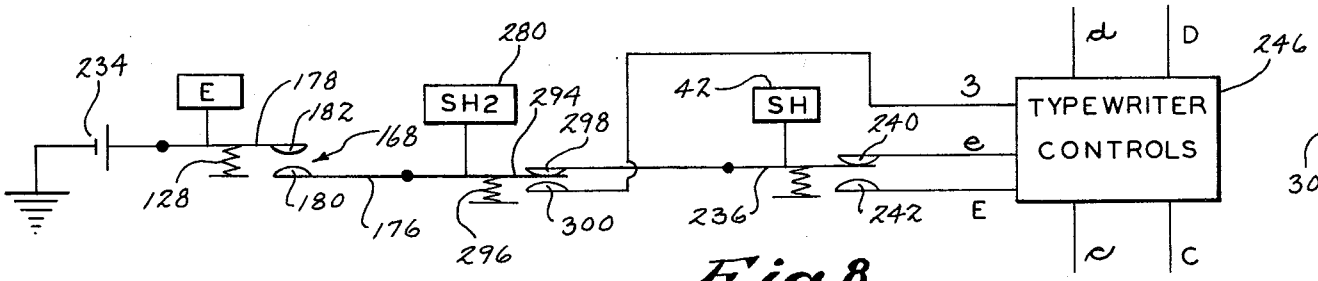
FIG. 8 is a schematic of electrical circuitry that may be used with the modified keyboard arrangement shown in FIG. 7.

The numerals 1–0 are disposed on the same upper ends of the keys 21B–30B as are the letters Q, W, E, R, etc. as is shown in FIG. 7 and has been described. Thus, the upper ends of the keys 21B–30B are depressed in order to cause a typing of the numerals 1–0; and the same switches, for example the switch 168 shown in FIG. 2 are used as for the letters Q, W, E, etc. In this connection, the circuitry of FIG. 8 may be used which illustrates an arrangement for causing either the "3" inlet lead for the controls 246 in lieu of either of the "e" or "E" input leads to be energized, depending on the positioning of the shift keys 280 and 282. The FIG. 8 circuitry includes the switch 168 with its contacts 180 and 182, and this switch is connected with the switch blade 294 of the shift key 280. The switch blade 294 is under the control of the spring 296, and the blade is adapted to make contact with either the contact 298 or the contact 300. The contact 298 is connected with the switch blade 236 actuated by the shift key 42, and the contacts 240 and 242 are connected with the inputs "e" and "E" of the controls 246. The contact 300 is connected with the "3" input of the controls 246 in FIG. 8. When the shift key 280 is depressed, the switch blade 194 is moved against the action of the spring 296 to complete a circuit from the blade 294 through the contact 300 to the "3" input to the controls 246. Thus when the switch 168 is subsequently closed by a depression of the forward portion of the key 23B, the "3" input to the controls 46 is energized causing the typewriter to print a "3". When the shift keys 280 and 282 are in their normal unactuated positions, the switch blade 294 is in contact with the contact 298; and the switch 168 when closed by a depression of the forepart of the key 23B causes an energization of either the "e" or the "E" inputs to the controls 246, depending on the positioning of the shift keys 41 and 42, this being in the same manner that the shift keys 41 and 42 are operative in the previously described FIG. 6 circuitry. All of the keys 21B–30B may be connected with similar FIG. 8 circuitry for causing any of the numerals 1, 2 and 4–0 to be typed when the upper ends of the respective keys 21B, 22B and 24B–30B are depressed.

Figure 12:
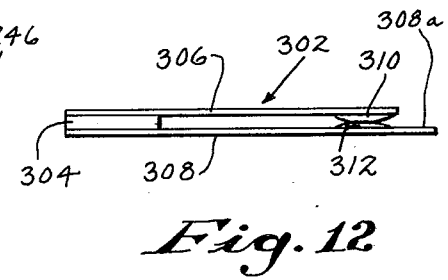
FIG. 12 is a side elevational view of a modified switch that may be used in connection with any of the keys of the keyboard of the invention.

The switches 168, 170, and 172 have been shown to be of the normally open type (open when a switch actuating force is not applied to the switch). In the event that the logic of the controls 246 is such as to require a switch that is opened when actuated instead of closed, a switch 302 shown in FIG. 12 of the normally closed type may be used. This switch 302 in particular may be substituted for the switch 172, and switches of the same normally closed type as switch 302 may be substituted for the other switches 168, 170, and 222. The switch 302 as shown in FIG. 12 comprises a slab 304 of insulating material that may be bonded to the web portion 98, a pair of electrically conducting leaf springs 306 and 308 and a pair of contacts 310 and 312 carried respectively by the leaf springs 306 and 308. The leaf spring 308 is provided with a reduced width end portion **308*a* which may extend between the web portion 98 and the shaft 106 to be actuated by the pin 148 when it moves downwardly in the slot 164**.

Advantageously, the keyboard arrangements of the invention allow for substantially less finger movement when typing than does the universal keyboard. This is particularly important when typing the letters of the alphabet, since this typing is by far the greatest portion of the typing generally done, while typing of the numerals probably does not constitute any more than 5 percent of the typing done on an average typewriter. For purposes of comparison, it may be assumed that the keys 21–30 have the same width of 13 mm as do the keys of a typical universal keyboard and are spaced 20 mm apart on centers and 6 mm apart at their closest surfaces, the same dimensions for the keys of any one row in the universal keyboard. It may also be assumed that the finger tablet surfaces in indentations 132, 134, and 136 have the same lengths of 13 mm longitudinally of the keys 21–30 as the lengths of the keys in the universal keyboard. The distance from the center line 50 passing through the centers of the keys 21–30 to the center line 54 and the distance from the center line 50 to the center line 56 is thus in each case only 13 mm so that the finger on any particular one of the keys 21–30 may thus only have to reach 13 mm from the center of the key to the center of the tablet surface **132*a* in indentation 132 or the tablet surface 136*a* in indentation 136 in order to type either a letter on the upper center line 54 or a letter on the lower center line 56. This may be contrasted with the reaching of about 21 mm from home position required for typing either a letter in the third row or a letter in the first row all in the same column using the universal keyboard. As is apparent, this saving in finger movement is due particularly to the fact than any one of the keys 21–30 is useful for typing three letters instead of just one, and there is no spacing between three keys as in the universal keyboard for accomplishing the same result. Although there is a spacing between the letter keys 21–30 and the numerical keys 31–40 in the FIG. 1 keyboard, there is nevertheless a corresponding saving in finger reaching accomplished, since the numerical keys 31–40 are located so much closer to the home row center line 50** than in the universal keyboard.

There is also a saving in the finger reaching required by the FIG. 1 keyboard due to the fact that the center lines 58, 60, 62, 64, 66, 68, 70, 72, 74, and 76 for the columns of keys are normal to the center line 50 and to the front edge 48 of the machine. Using the dimensions just proposed for the FIG. 1 keyboard, there would be a finger reaching of about 34 mm in order for the index finger of the left hand to first type a capital R and then type a capital B while for the same typing on the universal keyboard a finger reaching of about 52 mm would be required.

With the keys 21B–30B being slanted as shown in FIG. 7, a greater finger reaching would be required for typing than using the key arrangement of FIG. 1, nevertheless, the saving over the universal keyboard is substantial since the individual keys 21B–30B are used for each typing three letters instead of just one.

It will be noted that each of the finger typing actions using the keyboards of the invention is the same as previously used in connection with the universal keyboard in that each typing action of the letters in the first and third rows and the numerals in the fourth row is firstly a finger reaching motion from the home row followed by a depression of the appropriate key. Therefore, the use of the keyboards of the invention is easily learned.

The construction of the elongate keys 21–30 and 21B–30B is considered particularly advantageous for usage of these keys for typing three different letters depending on the way the key is used. The trough 130, the median longitudinal surfaces of which are below the side edges 23*c* and 23*d*, allows a typist to slide with his finger along the upper surface of the key out of home position on the center line 50 toward either end for typing of a letter in the first row or third row and then back again or else move from one of the extreme letter rows to the other, and the trough 130 tends to guide and keep the finger on the key all the time and to restrain the finger from undesired lateral movement off of the key which would be natural using the universal keyboard and to assure that the typist will not miss keys due to lack of accuracy in moving his fingers for typing different letters which requires in the universal keyboard a change of keys in each case. The trough 130*a* of FIGS. 9–10 has the same action. The upper curved ends 110*a* and 112*a* of the legs 110 and 112 located on the center lines 55 and 57 extending parallel with the front edge 48 of the machine in effect provide raised ridges dividing the tablet surface 132*a* from the tablet surface 134*a* and dividing the tablet surface 136*a* from the tablet surface 134*a*. It has been previously suggested herein that these leg portions 110*a* and 112*a* may actually be embedded in the key, such as the key 23 shown in FIG. 2, but nevertheless the portions of the key just above the curved leg ends 110*a* and 112*a* and on the center lines 55 and 57 will be raised and will be lower than the key edges 23*c* and 23*d*. The ridges 267 and 268 of FIG. 9 on the center lines 55 and 57 in the same manner are raised ridges dividing the tablet surfaces 132*a* 134*a* and 136*a*. Thus, as the typist moves his finger from home position on the center line 50, he is able to feel with his finger as his finger crosses either of the ridges 267 and 268 or channel ends 110*a* and 112*a* on the center lines 55 and 57 to determine that his finger has actually moved from its home position on to one of the end tablet surfaces 132*a* and 136*a*. The pointed bosses 138 and 140 slightly prick his finger when his finger completes its movement onto either tablet surface 132*a* or 136*a* thus indicating to the typist that the finger movement has actually been completed for a typing of a letter in the third row or in the first row. As the completion of the finger reaching motion has thus been signaled to the typist, he then depresses the key 23 (or any of the other elongated keys) so as to complete the typing action.

The arrangement of the pin 148 in the opening 146 of the web portion 98 advantageously assures that only one of the letters on any of the keys 21–30 or 21B–30B is typed on a key depression, corresponding to an actuation of only one of the switches 168, 170 and 172. In the key arrangement shown in FIG. 2, there is no tendency for the actuating member 150 to move the pin 148 substantially off of the center line 126 when the central tablet surface 134*a* is depressed since surface 134*a* is located between the supports 110*a* and 112*a* for the key 23 and since the lower part of the tablet surface 134*a* is at a lower level than the bearing surfaces 118*a* and 120*a*. In the FIG. 9 type of key support, there also is not substantial tendency for the actuating member 150 to swing to move the pin 148 out of position on the center line 126 when the key portion 134*a* is depressed since the lowermost portion of the tablet surface 134*a* shown in FIG. 9 is below the upper ends of the curved surfaces 264 and flats 266 and since the flats 266 and 274 provide a finger pressure activated detent as has been described. A finger pressure on the tablet surfaces 132*a* and 136*a* in FIG. 9 of course does provide a torque on the key 23A, since these surfaces are located on opposite sides of the center line 269 and at substantial distances therefrom. In this connection, it is clear that the channel 108 of FIG. 2 constitutes a support for the key 23 that permits the key to swing about either axis 114 or 116 and also permits the key to be depressed downwardly along the axis 126 that extends at right angles to the plane 314 which passes through the axes 114 and 116 and which is parallel with the plate 44 and with the top edges 23*a*–23*d* in the neutral position of the key 23 (shown in FIG. 2). The channel 270 of FIGS. 9–11 has substantially the same action with respect to the key 23A, but the swinging of the key 23A is substantially about the single axis 265 instead of two axes 114 and 116. The axis 265 is parallel with the plate 44 and with the top edges of the key 23A in the neutral position of the key, while the channel 270 allows the downward movement of the key 23A along the center line 269 that is at right angles to the axis 265. It is clear also that the axes 114, 116 and 265 extend transversely to the respective keys 23 and 23A so that the keys pivot longitudinally of the keys and that the center lines 126 and 269 of depressive movement of the respective keys are at right angles to the longitudinal center lines of the keys passing through the top edges 23*a* and 23*b* of the keys. Such a center line 62 is shown for the key 23 in FIG. 1.

Changes may obviously be made while still within the purview of the invention. For example, the elongate keys 21B–30B of FIG. 7 and carrying indicia of the numerals can be put normal to the front edge 48 of the machine in the same manner as the keys 21–30 are disposed. In lieu of providing the numerals on the keys 21B–30B disposed at the angle 288 with respect to the normal 290, separate numeral keys could be used in alignment with the respective keys 21B–30B; and these separate numeral keys would be located in line with the respective keys 21B–30B so that the centers of the numeral keys would lie on the longitudinal center lines of the keys 21B–30B. The various parts stated to be fixed together may of course be so fixed by any suitable means, such as epoxy bonding, soldering, welding, machine screws, etc. Although each of the keys 21–30 and 21B–30B is marked with a capital alphabetic letter, it is clear that these keys could just as well be marked with lower case alphabetic letters. Although electrical switches of the contact type have been illustrated and described herein in connection with the present invention, it is clear that other types of switches may instead be used, such as switches for example utilizing the Hall effect.

I claim:

1. Finger operated controlling mechanism including an elongated key having a finger thrust surface on which finger pressure can be applied for moving the key, means for mounting said key so that it can be moved on a thrust axis generally normal to said finger thrust surface and including transverse axis forming means for swingingly mounting the key so that it can be swung longitudinally of the key to have different rotative positions, three control devices, and an actuating member carried by said key so disposed that it can selectively actuate each of said control devices due to the movement of said key and actuating member on an operative stroke on said thrust axis with the particular one of said rotative positions determining which of said control devices is actuated on the operative stroke of the key, said finger operated controlling mechanism including means providing three slots and a part carried by said actuating member adapted to respectively enter the three slots for three different rotative positions of said key, said control devices being respectively in alignment with said slots to be actuated by said part when it moves through the three slots.

2. Finger operated controlling mechanism as said forth in claim 1, said control devices each constituting an electrical switch and being respectively in alignment with said slots to be actuated by said part when it moves through the three slots.

3. Finger operated controlling mechanism as said forth in claim 1 wherein said transverse axis forming means is a pivot for said key located substantially at the center of the key and wherein said part carried by said actuating member constitutes a pin, said control devices being in a series and the middle one of said slots being in alignment with said thrust axis and the other two slots being on opposite sides of said middle slot whereby said pin enters said middle slot when said key is depressed at its center and the pin enters the other two slots when the key is depressed adjacent its two ends.

4. Finger operated controlling mechanism as set forth in claim 3, said means providing the series of three slots including a plate having an opening therein and two spaced dividers extending into said opening so that the dividers provide the middle slot and the other two slots are each provided by one of the dividers and an adjacent edge of the opening, said opening having a pin receiving upper end, and a spring acting as a retractor for said key and moving said pin into the said pin receiving upper end of said opening and moving said key back into an original position after depression of the key.

5. Finger operated controlling mechanism as set forth in claim 4 and including a detent for yieldably holding said key in a neutral position in which said pin is in said pin receiving upper end of said opening and comprising two opposite flats in opposite parts of said pivot and in alignment with said thrust axis.

6. Finger operated controlling mechanism as said forth in claim 1, said transverse axis forming means constituting a pair of axes spaced along the key whereby the key may have said three rotative positions in the first of which it is supported by said two axes, in the second of which it is swung about and is supported by one of said axes and in the third of which it is swung about and is supported by the other of said axes.

7. Finger operated controlling mechanism as said forth in claim 6, said control devices each constituting an electrical switch.

8. Finger operated controlling mechanism as said forth in claim 1, said slots being in a series of a middle slot and two end slots and said part carried by said actuating member constituting a pin adapted to respectively enter the three slots in the three different rotative positions of said key, the middle one of said slots being in alignment with said thrust axis and the other two slots being on opposite sides of said middle slot whereby said pin enters said middle slot when said key is depressed at its center and the pin enters the other two slots when the key is depressed adjacent its two ends.

9. Finger operated controlling mechanism as set forth in claim 8, said means providing the series of three slots including a plate having an opening therein and two spaced dividers extending into said opening so that the dividers provide the middle slot and the other two slots are each provided by one of the dividers and an adjacent edge of the opening, said opening having a pin receiving upper end, and a spring acting as a retractor for said key and moving said pin into said pin receiving upper end of said opening and moving said key back into an original position after depression of the key.

10. Finger operated controlling mechanism as said forth in claim 1, said slots being in a series including two outermost slots, said two outermost slots being partially defined by leaf springs the ends of which come in close proximity with slanted surfaces defining the entrances to the slots and which are deformed by said part entering the two outermost slots for providing different tactile effects as said part enters the two outermost slots.

11. An elongate key for finger operated devices having a longitudinal trough in its upper surface the longitudinal center of which is on the longitudinal center line of the key whereby for guiding a finger longitudinally of the key, said key having first and second and third adjoining finger receiving recesses having their centers on the longitudinal center line of the key with said first and third recesses being on the ends of the key and of said trough, said recesses forming finger tablet bottom surfaces respectively in the trough and affording a means for locating a finger in predetermined positions longitudinally of the key for a subsequent depression of the portion of the key at the recess to which the finger is applied.

12. An elongate key as said forth in claim 11, said key being provided with transverse upraised dividing portions between said first and second recesses and between said second and third recesses which are lower in height than the depth of said trough and below the side edges of the key whereby a finger may remain in said trough while traveling longitudinally of the key between said recesses and over said dividing portions.

13. An elongate key as said forth in claim 11, the lengths of said first and third tablet surfaces longitudinally of the key being the same.

14. An elongate key as said forth in claim 11, the lengths of said first and second and third tablet surfaces being the same.

15. An elongate key as said forth in claim 11, the surfaces of said first and third recesses adjacent the ends of the key respectively closing the two ends of said trough.

16. An elongate key as set forth in claim 11, said tablet bottom surfaces being on the same level and the upper side and end edges of the key being at a common height above said tablet bottom surfaces.

17. An elongate key as set forth in claim 11, and an upwardly extending boss at the center of each of said finger tablet bottom surfaces of said first and third recesses for providing a tactile indication that a human finger is located in either of these recesses.

18. A finger operated keyboard comprising a row of elongate keys each having an exposed finger thrust surface on which finger pressure can be applied for moving the key and having their centers on a line extending transversely with respect to the longitudinal center lines of the keys, supporting means for mounting each said key so that the supporting means and key can be moved on a thrust axis generally normal to said finger thrust surface and including transverse axis forming means for swingably mounting the key relative to said supporting means so that it can be swung longitudinally of the key to have different rotative positions by finger pressure applied adjacent opposite ends of the key and being balanced with respect to the center of the key so that a finger pressure on the center of the key causes no rotative movement of the key, means responsive to movement of each key on its said thrust axis without key rotation by finger pressure on the center of its thrust surface for causing an operating action, and means responsive to movement of the key on said thrust axis with accompanying rotative movements of the key in different directions by finger pressure exerted adjacent opposite ends of the key thrust surface for causing two different other operating actions respectively.

19. A finger operated keyboard as said forth in claim 18, said means responsive to movement of the key for causing said operating actions including three control devices each actuated by a movement of said key on said thrust axis and mechanical switching means rendered effective by the relative rotation given said key about said transverse axis forming means for determining which one of said control devices is actuated on the movement of said key on said thrust axis.

20. A finger operated keyboard as said forth in claim 18, said transverse axis forming means including means providing a central axis on which the key may swing located substantially on a central plane of the key, and the finger operated keyboard including detent means for yieldably holding said key without key rotation so that said first named operating action may thereby be caused on a movement of the key on said thrust axis.

21. A finger operated keyboard as said forth in claim 18, said transverse axis forming means including means providing a central axis on which the key may swing located substantially on a central plane of the key, the finger operated keyboard including detent means for each key for yieldably holding the key without key rotation and of such construction that its detenting action is increased due to finger pressure applied on a central portion of its said finger thrust surface.

22. A finger operated keyboard as said forth in claim 18, said transverse axis forming means including means providing a pair of axes spaced longitudinally of the key about which the key may be swung so that finger pressure applied between said spaced axes does not tend to cause key rotation whereby said first named operating action may be obtained.

23. A finger operated keyboard comprising a row of elongate keys having their centers on a straight line extending transversely with respect to the longitudinal center lines of the keys, each of said keys having an exposed finger thrust surface with a longitudinal trough therein the longitudinal center of which is on the longitudinal center line of the key whereby for guiding a finger longitudinally of the key and for preventing the unwanted digression of the finger to an undesired adjacent key, each said key having first and second and third adjoining finger receiving recesses in its said thrust surface having their centers on the longitudinal center line of the key with said first and third recesses being on the ends of the key and of the trough and the key whereby for accurately locating a finger longitudinally of the key selectively in the different positions corresponding to the three recesses, means for mounting each of said keys so that the key may be depressed on a thrust axis generally normal to its said thrust surface and so that the key may be swung rotatively longitudinally of the key in opposite directions whereby the key may be depressed on said thrust axis without rotation by finger pressure applied in said second recess and may be depressed with a combination movement on said thrust axis and rotation of the key in different rotative directions by finger pressure applied respectively in said first and third recesses, and means connected with each of said keys for providing different operating actions when the key is depressed on said thrust axis with no rotation and with combinations of movement on said thrust axis and rotative movements in said different directions.

24. A finger operated keyboard as said forth in claim 23, each of said keys being provided with transverse upraised dividing portions between said first and second recesses and between said second and third recesses which are lower in height than the depth of said trough and below the side edges of the key whereby a finger may remain in said trough while traveling longitudinally of the key between said recesses and over said dividing portions.

25. A finger operated keyboard as set forth in claim 23, each of said keys extending at 90 degrees with respect to said straight line.

26. A finger operated keyboard as set forth in claim 23, each of said keys extending at about an angle of 22 degrees with respect to a normal to said straight line.

27. A finger operated keyboard as said forth in claim 23, the lengths of said first and third recesses longitudinally of each of said keys being the same.

28. A finger operated keyboard as said forth in claim 23, the lengths of said first and second and third recesses of each of said keys being the same.

29. A finger operated keyboard as said forth in claim 23, the surfaces of said first and third recesses adjacent the ends of each key respectively closing the two ends of said trough of the key.

30. A finger operated keyboard as set forth in claim 23, and an upwardly extending boss at the center of each of said first and third recesses for providing a tactile indication that a human finger is located in either of these recesses.

31. Finger operated controlling mechanism including a key having a finger thrust surface on which finger pressure can be applied for depressing the key, a support for said key mounted to be moveable along with the key when a depressive force is applied to the key, means for mounting said key on said support and including axis forming means carried by the support so as to allow the key to be swingable with respect to the support, a plurality of control devices, and an actuating member carried by said key for actuating said control devices in one manner on a movement of said key when the key is depressed and is in an initial unswung position with respect to said support and for actuating said control devices in other manners when the key is depressed and is swung on said axis forming means in opposite directions out of its said initial position with respect to said support, said axis forming means including detent means so constructed to be responsive in effect to the position of said key on said support and to be responsive to finger pressure applied on said key so as to hold the key in its unswung position on said support due to finger pressure when finger pressure is applied to the center of the key and to release to exert no restraining force on the key when finger pressure is applied adjacent either end of the key to swing the key in either direction to either of its swung positions.

32. Finger operated controlling mechanism as set said forth in claim 31, said axis forming means providing an axis for swingingly mounting said key on said support with upper opposite bearing surfaces which are located above an adjacent finger thrust surface portion centrally located longitudinally of the key so that finger force on said portion tends to hold the key in its said initial position with respect to said support.

33. Finger operated controlling mechanism as said forth in claim 32, said axis forming means providing a single swinging axis for the key located centrally of the key longitudinally of the key.

34. Finger operated controlling mechanism as set forth in claim 32, said axis forming means providing a pair of axes spaced along the key to have said finger thrust surface portion located between said axes longitudinally of the key.

35. Finger operated controlling mechanism as set forth in claim 31 and including a return spring effective on said support against which the support moves along with depressing movement of the key.

36. Finger operated controlling mechanism as set forth in claim 31, said control devices being three such devices arranged in a series, and said actuating member in its initial position corresponding to said initial position of said key actuating the middle one of said control devices when the key is depressed and is in its said initial position with respect to said support and actuating the other two of said control devices when the key is depressed and is swung on said axis forming means in opposite directions out of its said initial position with respect to said support.

37. Finger operated controlling mechanism as set forth in claim 36 and including a return spring effective on said support against which the support moves along with depressing movement of the key, and means providing two guiding edges effective on said actuating member as the actuating member is being moved toward each of said other two control devices with commensurate movements of said key for limiting the swinging movements of the actuating member along with the key due to finger pressure applied to the key against the action of said spring.

38. Finger operated controlling mechanism as said forth in claim 36, said axis forming means providing opposite bearing surfaces located centrally of the key and having opposite engaging surfaces which engage together on finger depressive force applied to said key centrally thereof on its said thrust surface tending to fix said key with respect to said support.

39. Finger operated controlling mechanism as said forth in claim 36, said axis forming means providing opposite bearing surfaces forming a single axis of rotation of said key located centrally of the key with opposite flats on said surfaces so located that finger depressive force applied centrally of said thrust surface tends to hold said flats together so as to yieldably fix the key with respect to said support, the portion of said finger thrust surface so effective on said flats being centrally located of said key and being at a lower level than said bearing surfaces in the direction of the finger force applied to said key.

40. Finger operated controlling mechanism as set forth in claim 26, said axis forming means providing two axes of rotation of said key spaced longitudinally of the key each provided by a pair of opposite bearing surfaces whereby finger depressive force applied to said key thrust surface in its middle causes said opposite bearing surfaces to remain engaged so that said key is thereby yieldably fixed with respect to said support in its said initial position and whereby said key may be rotated in opposite directions on said two axes for actuating said control devices in said other manners.

41. Finger operated controlling mechanism as said forth in claim 40, the portion of said finger thrust surface effective for yieldably fixing said key with respect with said support being located at a lower level than said two axes in the direction of the finger force applied to said key for augmenting the effect of the finger pressure in holding said bearing surfaces of said two axes of rotation together.

42. Finger operated controlling mechanism including a key having a finger thrust surface on which finger force can be applied for depressing the key, a support for said key mounted to be moveable along with the key when a depressive force is applied to the key, means for mounting said key on said support and including axis forming means carried by the support so as to allow the key to be swingable with respect to the support, a control device, an actuating member carried by said key for actuating said control device on a movement of said key when the key is depressed and is swung in one direction on said axis forming means out of an initial position, a spring effective on said support tending to return said key and support back to initial positions, and cam means effective on said actuating member as it travels back under the influence of said spring for swinging said actuating member and said back to initial positions on said axis forming means after release of said key.

43. Finger operated controlling mechanism as set forth in claim 42 and including a second control device, and said actuating member being effective on said second control device when said key is depressed without any swinging movement of said key on said axis forming means and said support.

44. Finger operated controlling mechanism as set forth in claim 43 and including a third control device, said actuating member carried by said key being effective for actuating the third one of said control devices on a swinging movement of the key on said axis forming means opposite to the direction in which the key is swung for actuating said first named control device, and cam means effective on said actuating member as it travels back under the influenece of said spring for swinging said actuating member and said key back to their initial positions on said support subsequent to a depression thereof accompanied by a swinging movement of said key in said opposite direction.

45. Finger operated controlling mechanism as set forth in claim 44, said two cams means including two cam edges tapering toward each other and terminating in a closed end notch and including also a projection on said actuating member riding on said edges and entering said notch as said key moves back towards its said initial position, with said projection and notch holding said key and said actuating member in initial positions against the action of said spring.

46. Finger operated controlling mechanism as set forth in claim 42 and including a second control device, and said actuating member being effective on said second control device on a movement of said key when the key is depressed and is swung in the opposite direction on said axis forming means out of said initial position, and cam means effective on said actuating member as it travels back under the influence of said spring for swinging said actuating member and said key back to their initial positions on said axis forming means subsequent to a depression of said key accompanied by a swinging movement of said key in said opposite direction.

47. Finger operated controlling mechanism as set forth in claim 46, said two control devices each including an electrical switch.

48. Finger operated controlling mechanism as set forth in claim 46, said two cam means including two cam surfaces tapering toward each other and including also a projection on said actuating member riding on said cam surfaces.

49. Finger operated controlling mechanism as set forth in claim 46, said two cam means including two cam surfaces tapering toward each other and including also a projection on said actuating member riding on said cam surfaces, said finger operated controlling mechanism including also a pair of opposite guiding surfaces extending parallel with each other and in the direction of movement of said support and each connected with one of said cam surfaces and effective on said projection for limiting the swinging movement of said key when the key is depressed.

50. Finger operated controlling mechanism as set forth in claim 46, said two cam means including two cam edges tapering toward each other and terminating in a closed end notch and including also a projection on said actuating member riding on said edges and entering said notch as said key moves back toward its said initial position, with said projection and notch holding said key and said actuating member in initial positions against the action of said spring.

51. Finger operated controlling mechanism including an elongated key having a finger thrust surface on which finger pressure can be applied for moving the key, means for mounting said key so that it can be moved on a thrust axis generally normal to said finger thrust surface and including supporting means for the key also movable on said thrust axis having transverse axis forming means for swingingly mounting the key relative to said supporting means so that it can be swung longitudinally of the key to have different rotative positions, two control devices each of which is responsive for changing its operative condition to a force applied substantially parallel with said thrust axis, and an actuating member carried by said key so disposed that it can selectively apply a force substantially parallel with said thrust axis on each of said control devices to actuate the device due to the movement of said key and actuating member on an operative stroke of the key on said thrust axis with the particular one of said rotative positions determining which of said control devices is actuated on the operative stroke of the key.

52. Finger operated controlling mechanism as set forth in claim 51 and including a third control device which is responsive for changing its operative condition to a force applied substantially parallel with said thrust axis, with the arrangement being such that when said key is depressed to be moved on said thrust axis and in three different rotative positions with respect to each other, said three control devices are respectively actuated by said actuating member for said three different rotative positions.

53. Finger operated controlling mechanism including a key having a finger thrust surface on which finger pressure can be applied for moving the key, means for mounting said key so that it can be moved on a thrust axis generally normal to said finger thrust surface and including axis forming means for swingingly mounting the key so that it can be swung to have different rotative positions, two control devices each of which is responsive to a force applied to it for changing its operative condition, an actuating member carried by said key and having a thrust part so disposed so that the thrust part can selectively apply a force on each of said control devices to actuate the device due to the movement of said key and actuating member on an operative stroke on said thrust axis with the particular one of said rotative positions determining which of said control devices is actuated on the operative stroke of the key, means defining a pair of paths for said thrust part to one or the other of said control devices, and impediment means in one of said paths for providing a tactile effect on said key when said part travels through this path to differentiate this path from the other of said paths.

54. Finger operated controlling mechanism as set forth in claim 53, said impediment means including a yieldable spring which yields on the passage of said thrust part along the path in which said impediment means is disposed.

55. Finger operated controlling mechanism as set forth in claim 54 and including a third control device which is also responsive for changing its operating condition to a force applied to it and located in a series with said first two named control devices so that said devices constitute a middle device and two end devices, said key and said actuating member being so arranged that said actuating member thrust part is effective on the middle one of said control devices in a non-rotated position of said key and is respectively effective on said other two devices when said key is swung in one direction or the other out of an initial central position, means defining a path for said thrust part to said third control device, and an impediment spring in the path to said third control device, with said two impediment springs being in the two paths to said two end control devices.

56. Finger operated controlling mechanism as set forth in claim 53, said impediment means constituting a pair of straight sided path edges meeting at a corner so that the passage of said thrust part across said corner provides a tactile effect on said key.

57. Finger operated controlling mechanism as set forth in claim 56 and including a third control device which is also responsive to changing its operative condition to a force applied to the device and located in a series with said two first named control devices so that said devices constitute a middle device and two end devices, said key and said actuating member being so disposed that the middle one of said three control devices is actuated by said thrust part on an operative stroke on said thrust axis by the key from an initial central position and the end devices are actuated by said thrust part on an operative stroke by said key on said thrust axis when said key is swung in one direction or the other out of its said initial position, and means defining a path for said thrust part to said third control device, said two straight sided path edges being provided in the path for one of said end control devices, and the path for said other end control device being provided by an additional pair of straight sided path edges coming together at a corner whereby this corner also provides a tactile effect on said key when said thrust part passes across the corner.

58. Finger operated controlling mechanism including a key having a finger thrust surface on which finger pressure can be applied for moving the key, means for mounting said key so that it can be moved on a thrust axis generally normal to said finger thrust surface and so that the key can be swung, said mounting means including a plunger constrained to move substantially parallel with said thrust axis, and axis forming means for swingingly mounting the key on said plunger so that the key can have different relative rotative positions with respect to said plunger a series of three control devices each of which is responsive for changing its operative condition to a force applied to the control device parallel with said thrust axis and constituting a middle control device and two end control devices, an actuating member carried by said key so disposed that it can selectively apply a force on each of said control devices to actuate the device due to the movement of said key and actuating member on an operative stroke on said thrust axis with the particular one of the relative rotative positions of the key determining which of said control devices is actuated on the operative stroke of the key, spring means for returning said plunger and actuating member and key back into their initial positions after such an operative stroke, means yieldably holding said key and actuating member in median positions in which the actuating member on said operative stroke is effective on the middle one of said control devices, and guide means effective on said actuating member for guiding the actuating member into engagement with each of said end control devices on an operative stroke of said key when said key and actuating member are swung with respect to said plunger on said axis forming means with opposite directions of rotation on the axis forming means and for limiting the swinging movement of said key and actuating member as the actuating member is effective on said two end control devices.

59. Finger operated controlling mechanism as said forth in claim 58, said actuating member constituting an arm which extends generally parallel with said thrust axis.

60. Finger operated controlling mechanism as said forth in claim 58, said actuating member constituting an arm that extends generally parallel with said thrust axis and which is relatively long compared to the distance between said axis forming means and the end of the key which swings about said axis forming means for providing a swinging movement of said key out of its said median position to a swung position in which one of the end control devices is actuated.

61. Finger operated controlling mechanism as said forth in claim 58, said axis forming means including means forming a single swinging axis disposed centrally of the key.

62. Finger operated controlling mechanism as said forth in claim 58, said axis forming means including means forming a pair of swing axes for said key spaced along the key so that the key can be swung on said axes in opposite directions.

63. Finger operated controlling mechanism including a key having a finger thrust surface on which finger force can be applied for depressing the key to move it on a thrust axis, a support for said key constrained to be moveable substantially parallel with said thrust axis, a spring effective on said support tending to move the support and said key back into initial positions, means for mounting said key on said support and including axis forming means carried by the support so as to allow the key to be swingable with respect to the support, a series of three control switches including a middle switch and two end switches, an actuating member carried by said key and arranged to move respectively toward the middle one of said control switches when the key is depressed against the action of said spring without swing movement with respect to said support and toward the end ones of said control switches when the key is depressed against the action of said spring with swinging movement in one direction or the other, and means for limiting the swinging movement of said actuating member when traveling toward said end switches and including a pair of guide edges for guiding the actuating member respectively effective for the swinging movement of said key and actuating member in the two directions, said axis forming means including means responsive to finger pressure for temporarily holding said key fixed with respect to said support when the key has finger pressure applied in a middle region of said finger thrust surface for depressing the key to cause said actuating member to actuate said middle switch.

64. Finger operated controlling mechanism as said forth in claim 63, said axis forming means including means providing a single swing axis for said key centrally located of the key and including co-acting journal surfaces, said journal surfaces having interfitting projection and recess means for temporarily holding said key fixed with respect to said support when the key has finger pressure applied in a middle region of said finger thrust surface.

65. Finger operated controlling mechanism as said forth in claim 63, said axis forming means including means providing a pair of key swing axes spaced from each other along the key whereby, when a finger pressure is applied in a middle region of said finger thrust surface, the finger pressure provides no swing torque on the key so that the key is thereby temporarily held fixed with respect to said support when the key is so depressed to cause the actuating member to actuate said middle switch.

66. (to take the place of claim 83) Finger operated controlling mechanism including a key having a finger thrust surface on which finger force can be applied to depress the key to move it on a thrust axis generally normal to said thrust surface, a support for said key, said support being mounted to be movable on said axis so that it moves along with said key when a depressive force is applied to the key, means for swingably mounting said key with respect to said support, electrical switch means, said key being constructed to actuate said switch means to change the condition of the switch means to first and second changed conditions when the key is depressed to more on said thrust axis respectively without swinging movement with respect to said support and with swinging movement with respect to said support in one direction, and means for releasably holding said key in an unswung relationship with respect to said support for causing said key when finger force is applied to the key at a place on said thrust surface substantially on said axis to cause said switch means to change to its said first changed condition.

67. Finger operated controlling mechanism as set forth in claim 66, said key being constructed also to actuate said switch means to change the condition of the switch means to a third changed condition when the key is depressed to move on said thrust axis with swinging movement with respect to said support in the opposite direction.

68. Finger operated controlling mechanism as set forth in claim 67, and a return spring effective on said support against the action of which depression of the key takes place.

69. Finger operated controlling mechanism as set forth in claim 68 and including a switch means actuating member carried by said key and arranged to actuate said switch means into its said three changed conditions, and means for guiding said actuating member in two opposite paths corresponding to the two swung positions of said key with respect to said support so that the actuating member is effective to change said switch means to its said second and third changed conditions.

70. Finger operated controlling mechanism as set forth in claim 69, said guiding means including two opposite stationary guiding edges for guiding said actuating member in said two opposite paths, said return spring being effective for holding a part of said actuating member against said guiding edges when finger force is applied to said key substantially off of said axis tending to cause the actuating member to move in said two paths.

71. A finger operated keyboard comprising a row of elongate keys each having a longitudinal trough in its upper surface the longitudinal center of which is on the longitudinal center line of the key whereby for guiding a finger longitudinally of the key, each of said keys having first and second and third adjoining finger receiving recesses having their centers on the longitudinal center line of the key with said first and third recesses being on the ends of the key and of said trough, said recesses forming finger tablet bottom surfaces respectively in the trough and affording a means for locating a finger in predetermined positions longitudinally of the key for a subsequent depression of the portion of the key at the recess to which the finger is applied, means for mounting each of said keys so that it may be depressed to move on a thrust axis substantially normal to said upper surface of the key, switch means actuatable when said key is depressed, and discriminating means responsive to finger pressure applied in said first and second and third recesses for causing said switch means to be actuated respectively differently for the finger pressure in said three recesses.

72. Finger operated controlling mechanism including an elongate key having a finger thrust surface on which finger force can be applied for depressing the key out of an initial position; supporting means for mounting said key so that the supporting means and key are movable on an operative stroke on a thrust axis generally normal to said finger thrust surface on the application of finger force on said thrust surface and including transverse axis forming means for swingably mounting the key relative to the said supporting means; electrical switch means actuated out of initial deactuated condition into three different actuated conditions by the action of said key in moving on said operative stroke on said thrust axis; discriminating means effective on said operative stroke on said thrust axis by said key to actuate said switch means to first and second and third changed conditions respectively when the key is depressed by finger force applied respectively at the center of the key thrust surface, at a place on said thrust surface between the center and one end of the thrust surface, and at a place between the center of the key thrust surface and the other end of the thrust surface; and a return spring effective on said supporting means and key against the action of which the key is moved on its said operative stroke and on said thrust axis and so connected with said key that it returns the key to its said initial position and thereby causes said switch means to return to its said initial condition when finger thrust is discontinued on the key.

73. Finger operated controlling mechanism as set forth in claim 72, said discriminating means including transverse axis forming means for swingably mounting the key on said supporting means so that it can be swung longitudinally of the key to have three relatively different rotative positions by finger force applied to said center and to said two other places on the thrust surface, and means responsive to said different rotative positions of the key as the key is being depressed to provide said first and second and third changed conditions of the switch means.

74. Finger operated controlling mechanism as set forth in claim 73, said different rotative positions of said key including a central unswung position and two outer swung positions at which the key is slightly tilted out of parallelism with respect to said thrust axis, and means for limiting the swing of said key to said slight tilt out of parallelism with respect to said thrust axis as the key is being moved on said operative stroke on said thrust axis to actuate said switch means.

75. Finger operated controlling mechanism as set forth in claim 74 and including means limiting the said operative stroke on said thrust axis, said switch means being located so that the switch means is actuated for the three different positions of swing of said key at the limit of the operative stroke of the key as the key is being depressed.

76. Finger operated controlling mechanism as set forth in claim 75 and including an arm carried by said key and an actuating pin on the arm, and means providing a fixed template opening into which said pin extends, the sides of said opening effective on said pin providing said means for limiting the swing of said key to said slight tilt and providing said means for limiting the said operative stroke on said thrust axis, the sides of said opening being so disposed with respect to each other that the movement of said pin parallel to said thrust axis and thereby the movement of said key on said thrust axis are substantially greater than the movement of said pin transversely of said thrust axis.

77. Finger operated controlling mechanism as set forth in claim 75 said supporting means including a plunger constrained for movement on said thrust axis and having said return spring effective thereon, and an actuator member carried by said key and effective on said switch means to actuate the switch means to its said three changed conditions as the key is moved on said thrust axis and is swung to have its said three rotative positions.

78. Finger operated controlling mechanism as set forth in claim 77 and including cam means effective on said actuator member for returning said key to its initial unswung position on said transverse axis forming means as said return spring is effective to return said plunger back to an initial position after the application of finger force on said key has ceased.

79. Finger operated controlling mechanism as set forth in claim 78 and including means providing a fixed template opening, and a pin fixed on said actuator member and extending into said template opening so that the edges of the opening guide and constrain the movement of said actuator member and thereby said key, said template opening having two opposite side edges for limiting the swing of the key to said two outer swung positions at which the key is slightly tilted out of parallelism with respect to said thrust axis, a bottom edge extending tranversely to said side edges for causing said plunger to be constrained to said operative stroke on said thrust axis and two upper opposite side edges tapering toward each other to constitute said cam means for returning said key to its initial unswung position, said two upper side edges meeting to form a closed end notch for restraining movement of said pin and thus said key under the return action of said spring.

80. Finger operated controlling mechanism as set forth in claim 72, said discriminating means including transverse axis forming means for swingably mounting the key so that it can be swung longitudinally of the key to have three relatively different rotative positions by finger force applied to said center and to said two other places on the thrust surface, and means responsive to said different rotative positions of the key as the key is being depressed to provide said first and second and third changed conditions of the switch means, said different rotative positions of said key including a central unswung position and two outer swung positions at which the key is tilted about 2 degrees out of parallelism with respect to said thrust axis, and means for limiting the swing of said key to said tilt of about 2 degrees out of parallelism with respect to said thrust axis as the key is being moved on said operative stroke on said thrust axis to actuate said switch means.

81. Finger operated controlling mechanism including an elongated key having a finger thrust surface on which finger pressure can be applied for moving the key, means for mounting said key so that it can be moved on a thrust axis generally normal to said finger thrust surface and including supporting means for the key also movable on said thrust axis having transverse axis forming means for swingingly mounting the key relative to the supporting means so that it can be swung longitudinally of the key to have different rotative positions, means for limiting the swinging movement of said key in both directions to a slight angle measured from a neutral position in which said finger thrust surface is normal to said thrust axis, electrical switch means so constructed that the switch means is changed into changed conditions on a thrust parallel with said thrust axis, and a thrust member carried by said key and effective on said switch means for providing a thrust on said switch means substantially parallel with said thrust axis for thus putting said switch means in one changed condition as the key is depressed on said thrust axis and is in one of its swung positions in one direction from its said neutral position and for putting said switch means in another changed condition as the key is depressed on said thrust axis and is in the other of its swung positions in the other direction from its said neutral position.

82. Finger operated controlling mechanism as set forth in claim 81 and including a projection provided on said thrust member, and means providing two slots into which said projection respectively moves when said key is depressed on said thrust axis and is in its two swung positions in the two directions from its said neutral position.

83. Finger operated controlling mechanism as set forth in claim 81 and including a projection provided on said thrust member, said means for limiting the swinging movement of said key including two opposite fixed edges on which said projection abuts for thus limiting the swinging movement of said key in opposite directions.

84. A finger operated keyboard comprising a row of elongate keys each having an exposed finger thrust surface on which finger pressure can be applied for moving the key and having their centers on a line extending transversely with respect to the longitudinal center lines of the keys, means for mounting each said key so that it can be moved on a thrust axis generally normal to its said finger thrust surface and including transverse axis forming means for swingably mounting the key so that it can be swung longitudinally of the key to have different rotative positions by finger pressure applied adjacent opposite ends of the key and being balanced with respect to the center of the key so that a finger pressure on the center of the key causes no rotative movement of the key, means responsive to movement of each key on its thrust axis without key rotation by finger pressure on the center of its thrust surface for causing an operating action, and means responsive to movement of the key on said thrust axis with accompanying rotative movements of the key in different directions by finger pressure exerted adjacent opposite ends of the key thrust surface for causing two different other operating actions respectively, said transverse axis forming means including bearing surfaces providing a single axis of key swing substantially on the central plane of the key and said thrust surface being provided with a central recess the bottom of which is at a lower level than said bearing surfaces so that finger pressure in said recess tends to hold the key centralized without key rotation.

85. A finger operated keyboard comprising a row of elongate keys each having an exposed finger thrust surface on which finger pressure can be applied for moving the key and having their centers on a line extending transversely with respect to the longitudinal center lines of the keys, means for mounting each said key so that it can be moved on a thrust axis generally normal to its said finger thrust surface and including transverse axis forming means for swingably mounting the key so that it can be swung longitudinally of the key to have different rotative positions by finger pressure applied adjacent opposite ends of the keys and being balanced with respect to the center of the key so that a finger pressure on the center of the key causes no rotative movement of the key, means responsive to movement of each key on its thrust axis without key rotation by finger pressure on the center of its thrust surface for causing an operating action, and means responsive to movement of the key on said thrust axis with accompanying rotative movements of the key in different directions by finger pressure exerted adjacent opposite ends of the key thrust surface for causing two different other operating actions respectively, said transverse axis forming means including means providing a pair of axes spaced longitudinally of the key about which the key may be swung so that finger pressure applied between said spaced axes does not tend to cause key rotation whereby said first named operating action may be obtained, said finger thrust surface including a central recess the bottom of which is located at a lower level than the upper bearing parts forming said two axes providing an additional force for holding said key in an unrotated position for obtaining said first named operating action.

86. A keyboard comprising an elongate key and a relatively short key separated from the elongate key and having its center on the longitudinal center line of said elongate key, means for mounting said short key so that it can be depressed on a thrust axis, means for mounting said elongate key so that it can be depressed on a thrust axis generally normal to a finger thrust surface on the key and so that it can be swung slightly with such depression in opposite directions from a central unswung position, electrical switch means actuated by said short key when it is depressed, and other electrical switch means actuated by said elongate key when depressed without swinging movement to change the latter switch means into a first changed condition and to change the latter switch means into second and third changed conditions when the elongate key is depressed on its thrust axis and is swung in one direction or the other direction from its said central unswung position respectively concomitantly with its movement on said thrust axis.

87. A keyboard as set forth in claim 86, said keyboard also including additional pairs of short keys and elongate keys positioned so that said short keys are in a row and said elongate keys are in another row, and additional switch means of the same types as aforesaid for said additional short and elongate keys.

* * * * *